US007960636B2

(12) United States Patent
Demsey et al.

(10) Patent No.: US 7,960,636 B2
(45) Date of Patent: Jun. 14, 2011

(54) ENHANCED KNOB FOR USE WITH AN ELECTRIC STRINGED MUSICAL INSTRUMENT

(75) Inventors: Seth Mitchell Demsey, Seattle, WA (US); Thomas George Lorimor, Seattle, WA (US)

(73) Assignee: Zero Crossing Inc., Redmond, WA (US)

( * ) Notice: Subject to any disclaimer, the term of this patent is extended or adjusted under 35 U.S.C. 154(b) by 110 days.

(21) Appl. No.: 11/599,003

(22) Filed: Nov. 13, 2006

(65) Prior Publication Data

US 2007/0180976 A1 Aug. 9, 2007

Related U.S. Application Data

(60) Provisional application No. 60/771,580, filed on Feb. 7, 2006.

(51) Int. Cl.
*G10G 7/02* (2006.01)
*G10H 1/44* (2006.01)

(52) U.S. Cl. ..... 84/455; 84/464 A

(58) Field of Classification Search ..... 84/DIG. 18, 84/454, 455, 458, 464 R, 464 A
See application file for complete search history.

(56) References Cited

U.S. PATENT DOCUMENTS 5,549,028 A 8/1996 Steinberger et al.
5,637,820 A * 6/1997 Wittman ..... 84/454
5,760,754 A * 6/1998 Amero et al. ..... 345/82
5,777,248 A * 7/1998 Campbell ..... 84/454
6,627,829 B2 * 9/2003 Sato ..... 200/310
6,787,690 B1 * 9/2004 Celi et al. ..... 84/723
2006/0174755 A1 * 8/2006 Ito ..... 84/724
2007/0006716 A1 * 1/2007 Salmond et al. ..... 84/600

OTHER PUBLICATIONS

"Tronical Unveils PowerTune Automatic Self-Tuning Guitar System for Electric Guitars", Harmony Central Winter NAMM 2006, Jan. 21, 2006, pp. 1-4.

* cited by examiner

*Primary Examiner* — Elvin G Enad
*Assistant Examiner* — Andrew R Millikin
(74) *Attorney, Agent, or Firm* — Olympic Patent Works PLLC

(57) ABSTRACT

Various embodiments of the present invention are directed to an enhanced knob with multiple integrated functions for use with an electric stringed musical instrument. The enhanced knob can be positioned on an electric stringed musical instrument or on an interconnected amplifier and can be either an add-on feature or can replace one or more existing knobs. In one embodiment of the present invention, the volume knob for an electric guitar is removed and replaced by an enhanced knob. The enhanced knob includes a switch that allows a user to switch between the multiple functions and also allows the user to control each selected function. The enhanced knob includes a volume function to compensate for the removed volume knob. Additionally, the enhanced knob includes a number of other functions, including a tuner function, a metronome function, and a dynamic visual-display function.

28 Claims, 29 Drawing Sheets

ENHANCED KNOB FOR USE WITH AN ELECTRIC STRINGED MUSICAL INSTRUMENT

CROSS-REFERENCE TO RELATED APPLICATION

This application claims the benefit of Provisional Application No. 60/771,580, filed Feb. 7, 2006.

TECHNICAL FIELD

The present invention relates to the field of electric stringed musical instruments, and, in particular, to an enhanced knob for use with an electric stringed musical instrument.

BACKGROUND OF THE INVENTION

Stringed musical instruments form the backbone of popular music in many countries around the world. Unfortunately, many stringed musical instruments regularly drift out of tune due to local environmental changes, such as changes in temperature and humidity, as well as from being physical disturbed, such as being bumped, jostled, or even played. As a result, many stringed musical instruments need to be regularly tuned. One commonly-used technique for tuning stringed instruments is using one's ear to identify the proper frequency of each string of a stringed musical instrument. However, many people are not blessed with the aural acumen needed to tune a stringed musical instrument by ear. Additionally, tunings may need to be performed when local noise levels are too high for a person to be able to hear well enough to tune a stringed musical instrument by ear.

Another commonly-used technique for tuning stringed instruments includes using one or more tone generators, including tuning forks, pitch pipes, telephone dial tones, or other musical instruments. A tone generator can be used to produce an audible reference tone that a person can compare to the frequency of a string on a stringed musical instrument being tuned. However, tone generators are not always readily available and can be burdensome to maintain. Additionally, using tone generators to tune stringed musical instruments can be difficult for people without pitch-perfect hearing and/or when used under noisy conditions.

Yet another commonly-used technique for tuning stringed musical instruments is using electronic tuning devices. Electronic tuning devices can be useful for people that do not have the ability to discern between strings that are in tune and strings that are not in tune, and for use in noisy environments. However, electronic tuning devices can be expensive, cumbersome, and inconvenient to use.

Many people enjoy using a metronome to set a tempo while playing a stringed musical instrument. Unfortunately, metronomes may be inconvenient or unfeasible to use in certain locations. Additionally, some stringed-musical-instrument players enjoy incorporating dynamic visual displays into their musical performances. However, integrating dynamic visual displays, such as flashing lights, can be expensive and burdensome. Additionally, arranging dynamic visual displays to flash in relation to music being played can be especially burdensome. Stringed-musical-instrument players, as well as people that enjoy listening to stringed musical instruments have, therefore, recognized a need for a better way to tune a stringed musical instrument, set an accompanying tempo, and incorporate a dynamic visual display into created musical performances without providing a number of additional expensive and burdensome devices.

SUMMARY OF THE INVENTION

Various embodiments of the present invention are directed to an enhanced knob with multiple integrated functions for use with an electric stringed musical instrument. The enhanced knob can be positioned on an electric stringed musical instrument or on an interconnected amplifier and can be either an add-on feature or can replace one or more existing knobs. In one embodiment of the present invention, the volume knob for an electric guitar is removed and replaced by an enhanced knob. The enhanced knob includes a switch that allows a user to switch between the multiple functions and also allows the user to control each selected function. The enhanced knob includes a volume function to compensate for the removed volume knob. Additionally, the enhanced knob includes a number of other functions, including a tuner function, a metronome function, and a dynamic visual-display function.

DETAILED DESCRIPTION OF THE INVENTION

Various embodiments of the present invention are directed to an enhanced knob for use with an electric stringed musical instrument ("instrument"). The enhanced knob can be positioned on an instrument or an interconnected amplifier and can be either an add-on feature or can replace one or more existing knobs, such as a volume knob, a tone knob, or a pick-up selector. The enhanced knob may include a number of integrated functions, including a tuner function, a metronome function, and a dynamic visual-display function. Additionally, when the enhanced knob is used to replace an existing knob, the enhanced knob also includes the function of the removed knob, such as a volume function, a tone function, or a pick-up-selector function.

Figure 1:
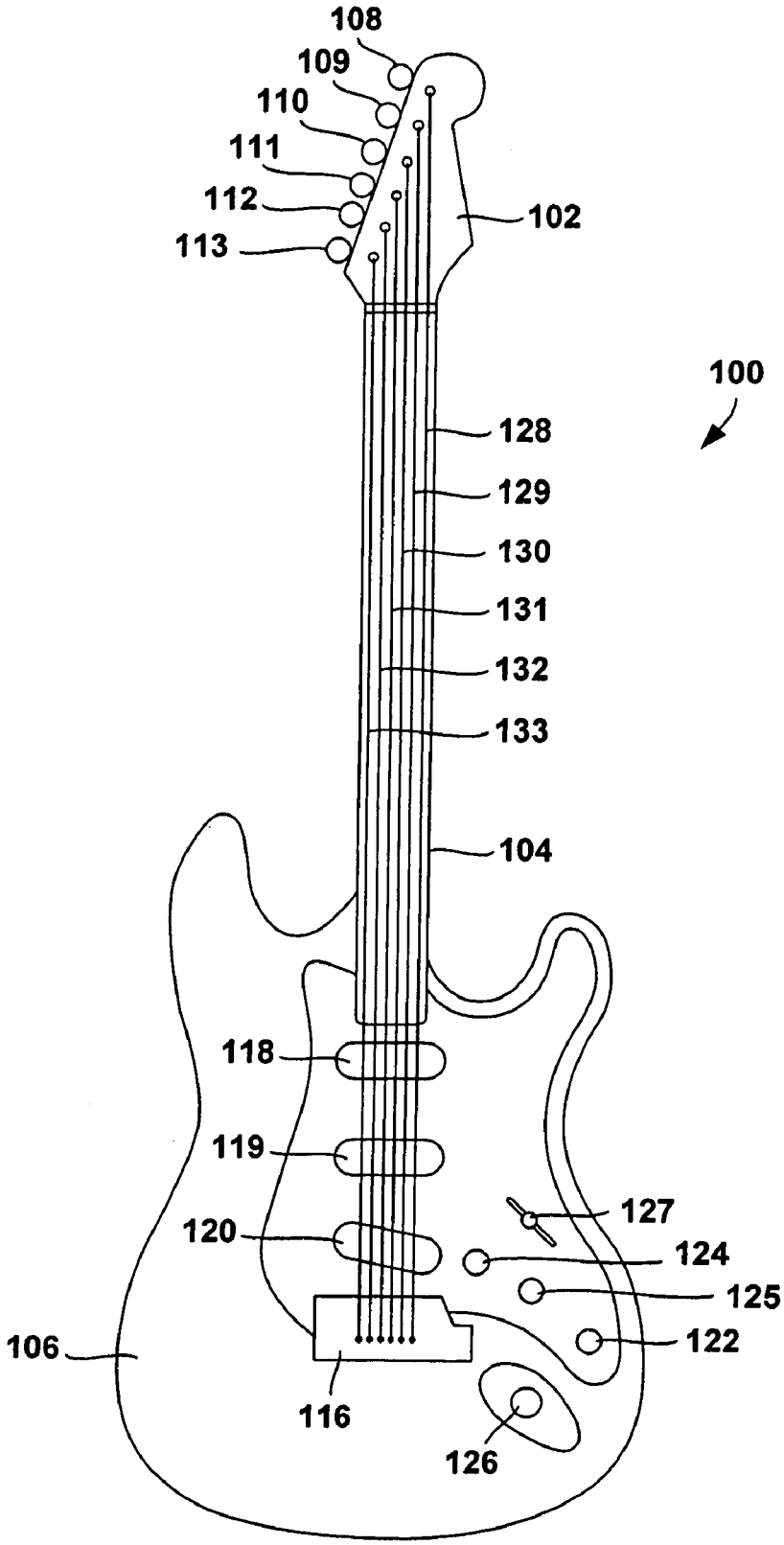
FIG. 1 shows a front view of an electric guitar.

In one embodiment of the present invention, a knob on an electric guitar is replaced with an enhanced knob. Although the enhanced knob is described in relation to an electric guitar, the enhanced knob can be used with other types of electric stringed musical instruments, such as electric basses, electric violins, electric banjos, and other electric stringed musical instruments. FIG. 1 shows a front view of an electric guitar. An electric guitar 100 includes a headstock 102, a neck 104, and a body 106. The headstock 102 contains six tuning pegs 108-113. The body 106 contains a bridge 116, three pick-ups 118-120, a volume knob 122, two tone knobs 124 and 125, an output jack 126, and a pick-up selector 127. Six metallic strings 128-133 extend from the bridge 116 to the six tuning pegs 108-113, respectively.

When a user plays the electric guitar 100, the user creates a vibration along one or more of the strings 128-133 by plucking, raking, picking, hammering, tapping, slapping, or strumming ("playing") one or more of the strings 128-133 with a first hand while pressing a number of the played strings against the neck 104 at various locations with a second hand. The location along the neck 104 of the second hand pressing down on a given played string determines the frequency of the vibrations produced by that string. The character of the sound eventually output by the electric guitar 100 may be influenced by the way each of the strings 128-133 is played. Additionally, the volume and the timbre of the sound may be influenced by adjusting the volume knob 122 and the tone knobs 124 and 125, respectively.

The six strings 128-133 pass over the three pickups 118-120. Each pick-up 118-120 contains a number of magnets wrapped in wire. The vibrations of an overlying metallic string cause a signal to be induced in one or more of the wires wrapped around one or more of the magnets. The signal passes along an electric-guitar circuit from one or more of the pickups 118-120 to the output jack 126. An electric-guitar cable (not shown in FIG. 1) can be input to the output jack 126 to interconnect the electric guitar 100 to other devices, such as an amplifier. Note that different types of electric guitars can have different numbers of pick-ups, volume knobs, tone knobs, and other features. For example, a first electric guitar may have one pick-up and a second electric guitar may have four pick-ups. A third electric guitar may have a separate volume knob for each pick-up selector and a fourth electric guitar may not have any tone knobs.

Figure 2:
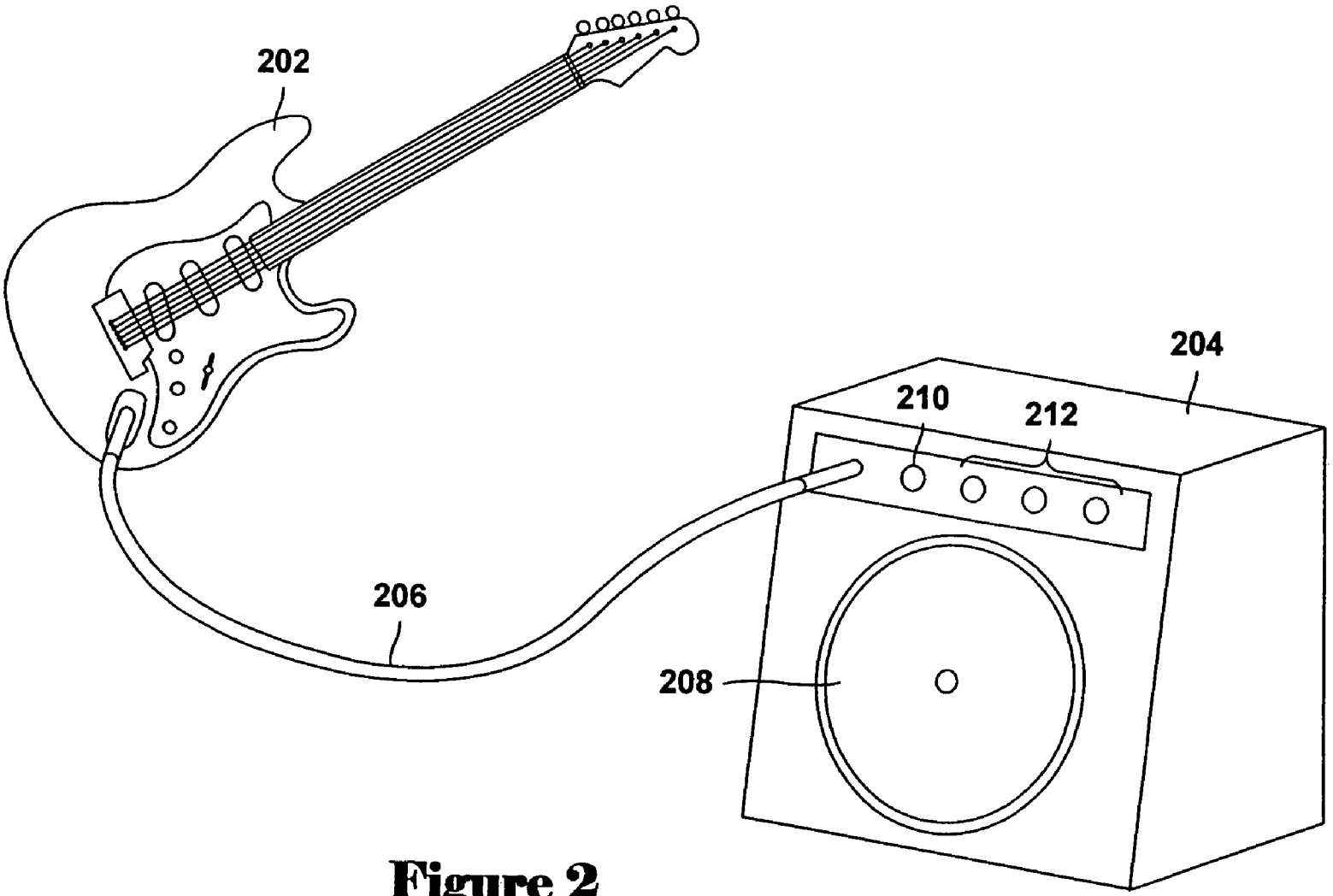
FIG. 2 shows an electric guitar interconnected to an amplifier.

FIG. 2 shows an electric guitar interconnected to an amplifier. In FIG. 2, an electric guitar 202 is interconnected to an amplifier 204 via an electric-guitar cable 206. When the electric guitar 202 is interconnected to the amplifier 204, signals output from an electric-guitar circuit are passed through the output jack (126 in FIG. 1) and into the electric-guitar cable 206. Signals in the electric-guitar cable 206, in turn, are output from the electric-guitar cable 206 to the amplifier 204. The amplifier 204 amplifies input signals and outputs audible sounds from one or more interconnected speakers 208. The amplifier 204 may also provide various means to alter the character of the sound eventually output from the one or more speakers 208, such as one or more volume knobs 210 and one or more tone knobs 212. The character of the sound eventually output from the one or more speakers 208 may also be influenced by passing a signal through additional devices prior to passing the signal to the amplifier 204. For example, a signal can be passed through one or more intervening effects pedals. Additionally, various electric guitars may utilize different types of output jacks 126, such as output jacks that mate with electric-guitar cables that include a quarter-inch tip-sleeve connection common in the art. However, some electric guitars may, instead, utilize wireless transmitters.

Figure 3:
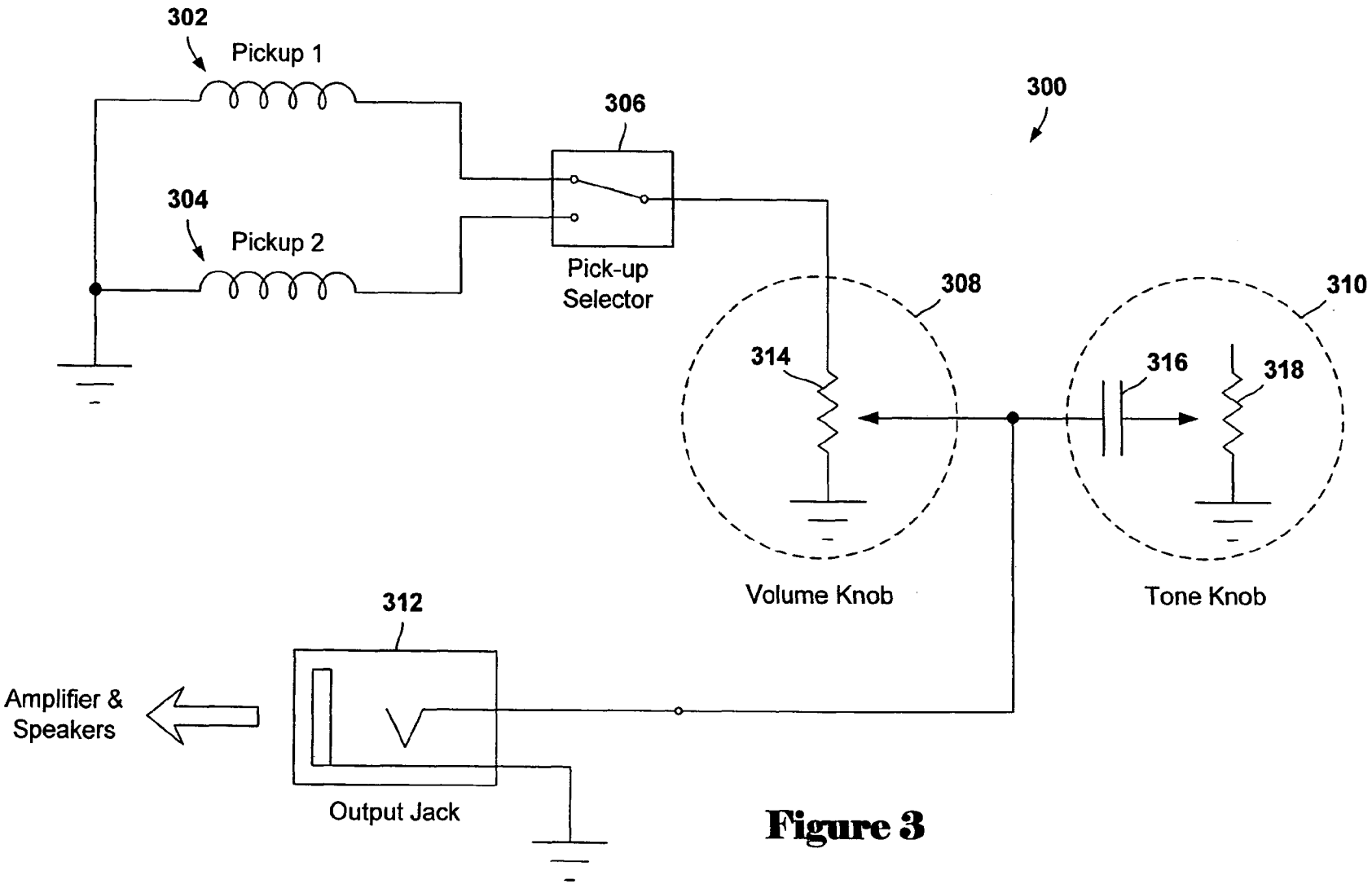
FIG. 3 shows a schematic diagram of an exemplary electric-guitar circuit.

FIG. 3 shows a schematic diagram of an exemplary electric-guitar circuit. An electric-guitar circuit 300 includes a first pick-up coil 302, a second pick-up coil 304, a pick-up selector 306, a volume adjuster 308, a tone adjuster 310, and an output jack 312. The pick-up selector 306 allows a user to select to receive a signal from one of the available pick-ups of an electric guitar. In FIG. 3, "Pickup 1" has been selected. In FIG. 3, the volume adjuster 308 and the tone adjuster 310 are shown as dashed circles surrounding various associated electrical components. The volume adjuster 308 includes one or more adjustable volume resistors 314. The tone adjuster 310 includes a band-pass filter comprised of one or more capacitors 316 and one or more adjustable tone resistors 318. The volume adjuster 308 and the tone adjuster 310 can be user controlled by a number of different means, such as by knobs interconnected to one or more potentiometers.

A vibrating string in the proximity of a selected pick-up coil 302 and 304 causes the transmission of an induced signal through the volume adjuster 308 ("volume knob") and the tone adjuster 310 ("tone knob") before reaching the output jack 312. A user can use the volume knob 308 and/or the tone knob 310 to adjust the character of the sound eventually output to an amplifier and interconnected speaker. Additional knobs and controllers can be interconnected to the electric-guitar circuit shown in FIG. 3, including additional volume knobs and additional tones knobs.

Figure 4A:
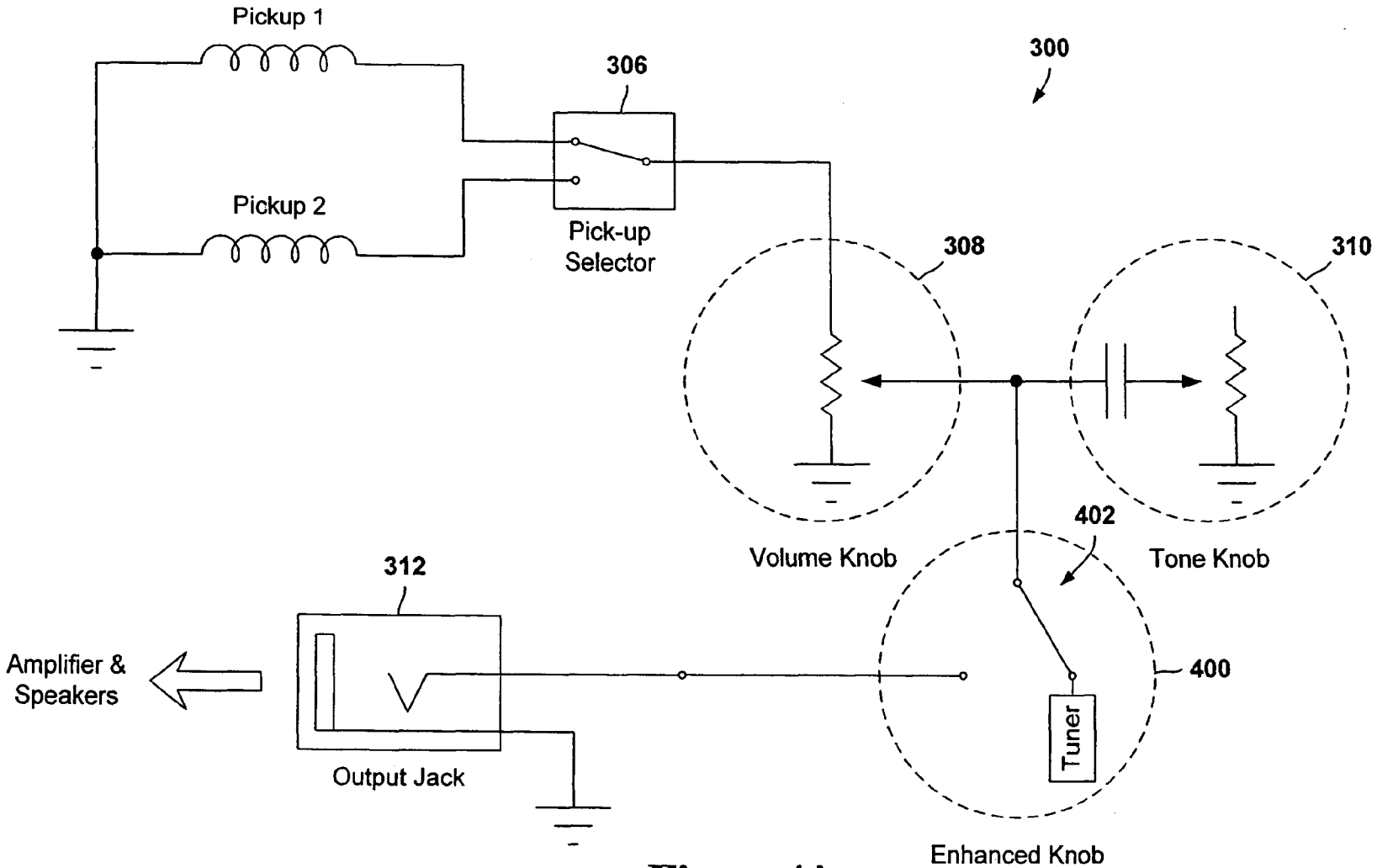
FIG. 4A shows a schematic diagram of the electric-guitar circuit shown in FIG. 3 with an interconnected enhanced knob that includes a tuner function and that represents one embodiment of the present invention.

When an enhanced knob is an add-on feature for an instrument, the enhanced knob can be added to the instrument circuit. FIG. 4A shows a schematic diagram of the electric-guitar circuit shown in FIG. 3 with an interconnected enhanced knob that includes a tuner function and that represents one embodiment of the present invention. An enhanced knob 400 includes a switch 402 for switching between a tuner function and completing the electric-guitar circuit 300. In FIG. 4A, the enhanced knob 400 is shown in the electric-guitar circuit 300 between the output jack 312 and the volume knob 308 and the tone knob 310. However, the enhanced knob 400 can alternately be positioned between the pick-up selector 306 and the volume knob 308 and the tone knob 310. Similarly, when an enhanced knob that includes a tuner function is positioned on an amplifier as an add-on feature, the enhanced knob includes a switch for switching between the tuner function and completing the amplifier circuit.

Figure 4B:
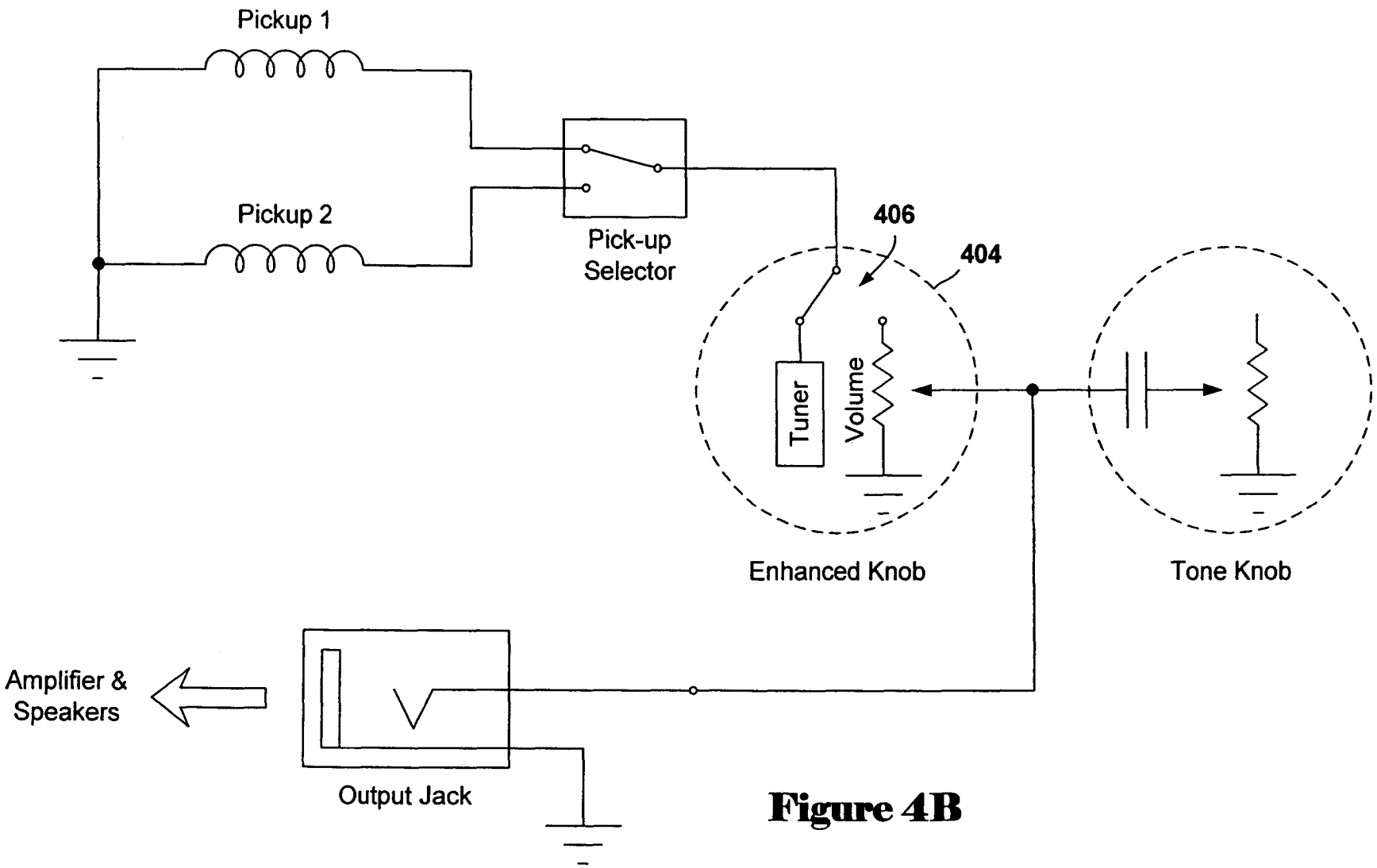
FIG. 4B shows a schematic diagram of the electric-guitar circuit shown in FIG. 3 with a volume knob replaced with an enhanced knob that includes a tuner function and that represents one embodiment of the present invention.

When a knob for an instrument or an interconnected amplifier is replaced with an enhanced knob, the enhanced knob can switch between the function of the removed knob and one or more other functions. For example, when a volume knob on an electric guitar is replaced with an enhanced knob, the enhanced knob may switch between a volume function and one or more additional functions, such as a tuner function. FIG. 4B shows a schematic diagram of the electric-guitar circuit shown in FIG. 3 with a volume knob replaced with an enhanced knob that includes a tuner function and that represents one embodiment of the present invention. In FIG. 4B, an enhanced knob 404 is shown represented as a dashed circle surrounding a volume function and a tuner function. The enhanced knob 404 includes a switch 406 for switching between the volume function and the tuner function. Both the volume function and the tuner function are user controlled. Thus, a user can use the enhanced knob 404 to select and use the volume function, or the user can switch to the tuner function and use the enhanced knob to aid the user with tuning the electric guitar. When an enhanced knob with a tuner function is positioned on an amplifier as a replacement knob for a volume knob, the enhanced knob similarly includes a switch for switching between the tuner function and a volume function.

Many different types of switches can be used for switches 402 and 406, including a momentary-contact switch, a touch switch, a push-pull switch that is operated by pushing and/or pulling the enhanced knob 400 into/out-from the body (106 in FIG. 1) of an electric guitar, a rotational-click switch that remains in the volume function until a user rotates the enhanced knob 400 far enough in one direction so that the volume is reduced to an inaudible level and a "click" occurs, indicating that the switch 402 has been switched to the tuner function, or many other types of switches.

Figure 5:
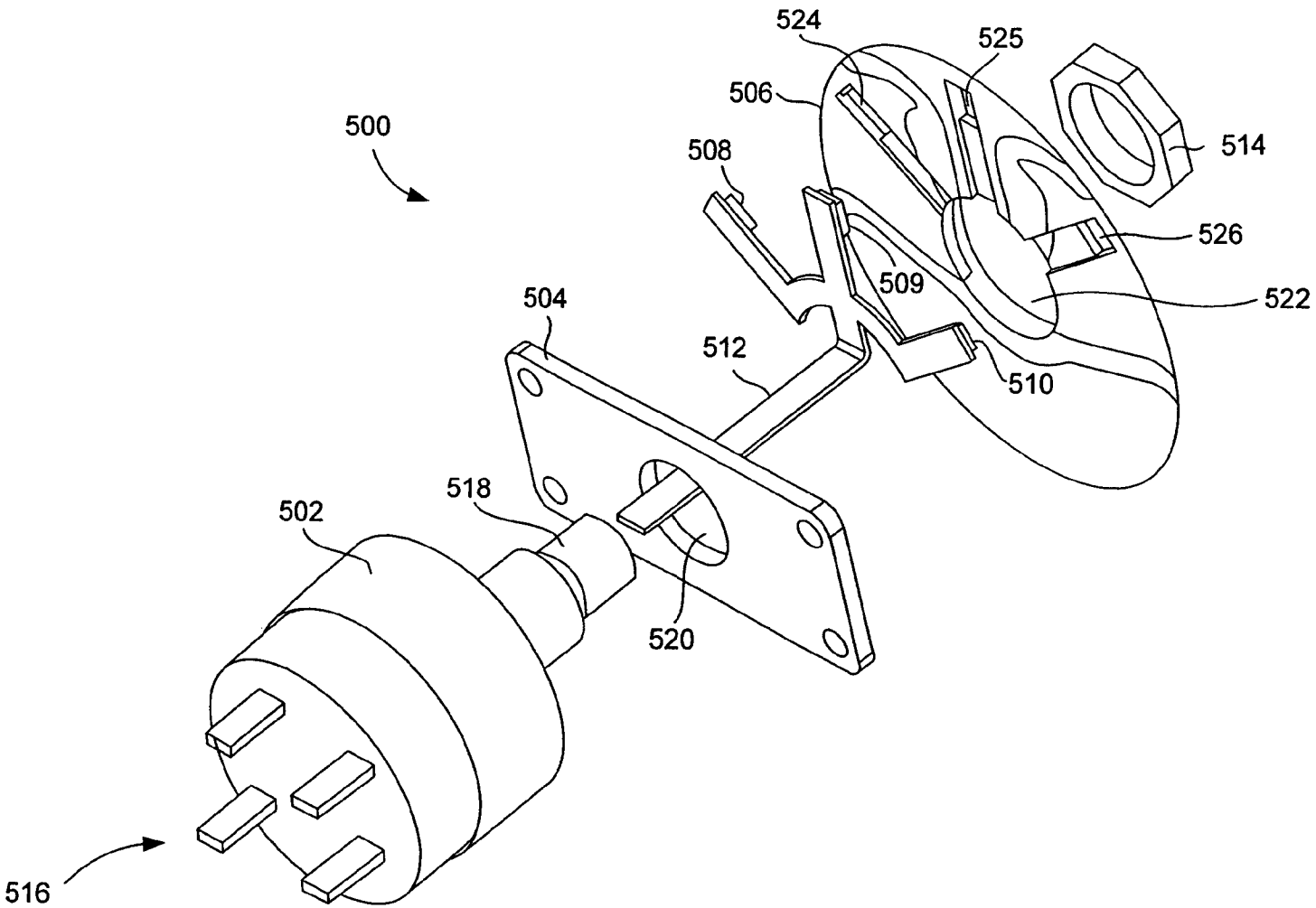
FIG. 5 shows an exploded view of an enhanced knob that includes a tuner function and that represents one embodiment of the present invention.

FIG. 5 shows an exploded view of an enhanced knob that includes a tuner function and that represents one embodiment of the present invention. An enhanced knob 500 with a tuner function includes a potentiometer ("pot") 502, a printed circuit board ("PCB") 504, a display ring 506, three light-emitting diodes ("LEDs") 508-510, an electronically-communicating means 512 for interconnecting the pot 502 to the LEDs 508-510, and a nut 514 that mates with the pot 502 to hold the PCB 504 and the display ring 506 firmly against the pot 502. The pot 502 contains leads 516 for interconnecting the pot 502 to an instrument circuit, such as the electric-guitar circuit shown in FIG. 3, and a stem 518 with a threaded base (not shown in FIG. 5) onto which the nut 512 can be threaded and that can also be used to interconnect a knob cap (not shown in FIG. 5) for use by a user for grasping and using the enhanced knob 500. The PCB 504 is shown with a mounting aperture 520 that fits around the threaded base of the stem 518 so that the PCB 504 can be slid down the stem 518. In one embodiment of the present invention, the PCB 504 is soldered to the pot 502.

The display ring 506 contains a central aperture 522 that fits around the threaded base of the stem 518 so that the display ring 506 can also be slid down the stem 518. The underside of the display ring 506 contains three depressions 524-526 into which the LEDs 508-510 can be placed. The display ring 506 can be attached to the electronically-communicating means 512 in a number of different ways, such as one or more adhesives, and/or pressure from being sandwiched between the nut 512 and the PCB 504 and/or the pot 502.

FIG. 5 shows each of the three LEDs 508-510 separated from one another and located in proximity to the distal ends of the electronically-communicating means 512. The electronically-communicating means 512 can be fabricated from a number of different electronically-conducting materials, such as metal wires and/or a PCB/ribbon-cable combination. In alternate embodiments of the present invention, a different number of LEDs are used than three, as discussed below with reference to FIGS. 9-14.

The enhanced knob 500 also contains a power supply (not shown in FIG. 5) for powering the LEDs 508-510. In one embodiment of the present invention, one or more batteries are in electronic communication with the pot 502, the PCB 504, the LEDs 508-510, and the electronically-communicating means 512. The batteries may be placed inside an instrument in proximity to the enhanced knob 500. In one embodiment of the present invention, one or more batteries are mounted into a compartment inside the body of an electric guitar. In alternate embodiments of the present invention, the batteries are placed external to the electric guitar in an interconnected battery pack.

Figure 6A:
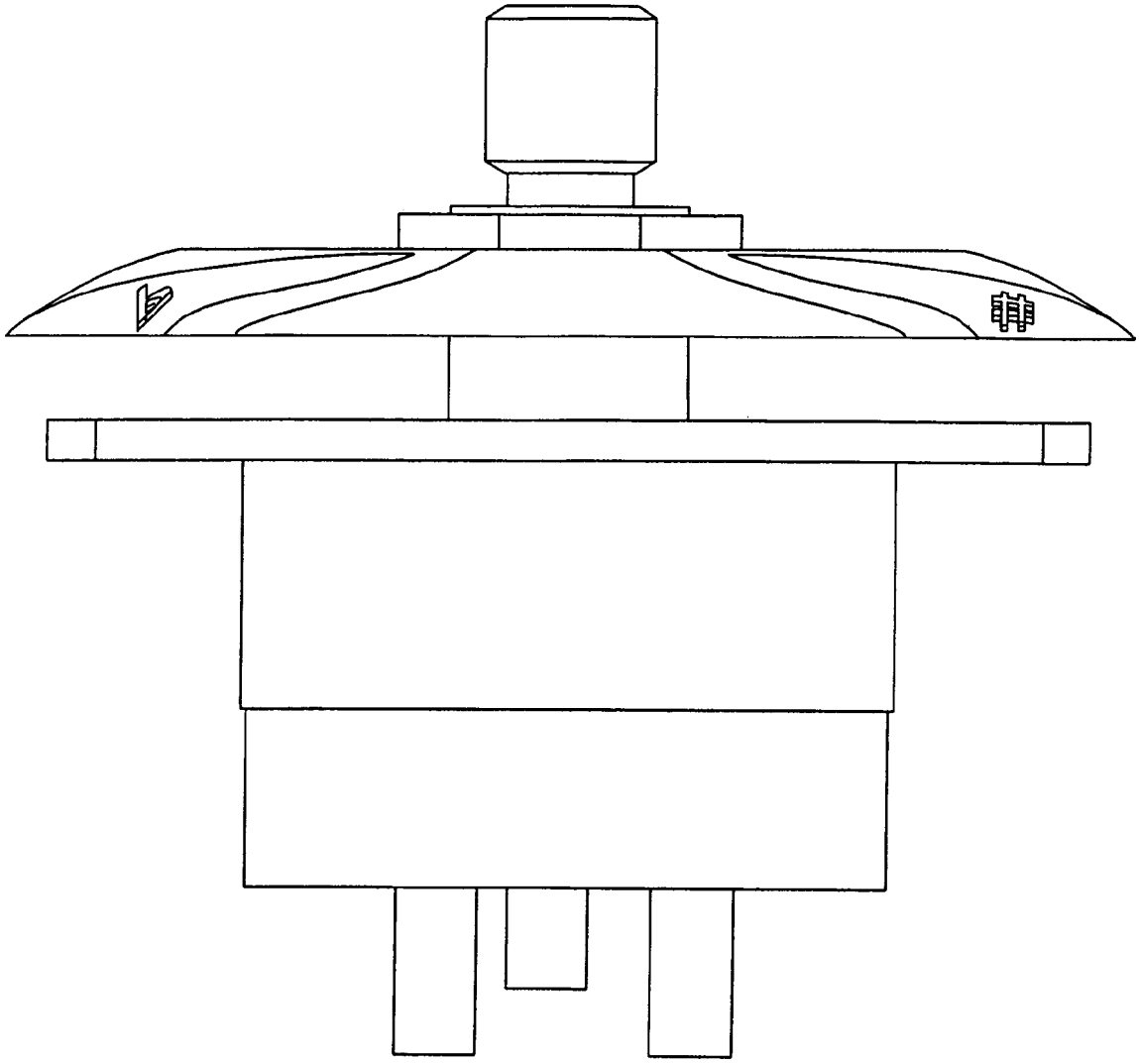
FIG. 6A shows a side view of the enhanced knob shown in FIG. 4 that represents one embodiment of the present invention.
Figure 6B:
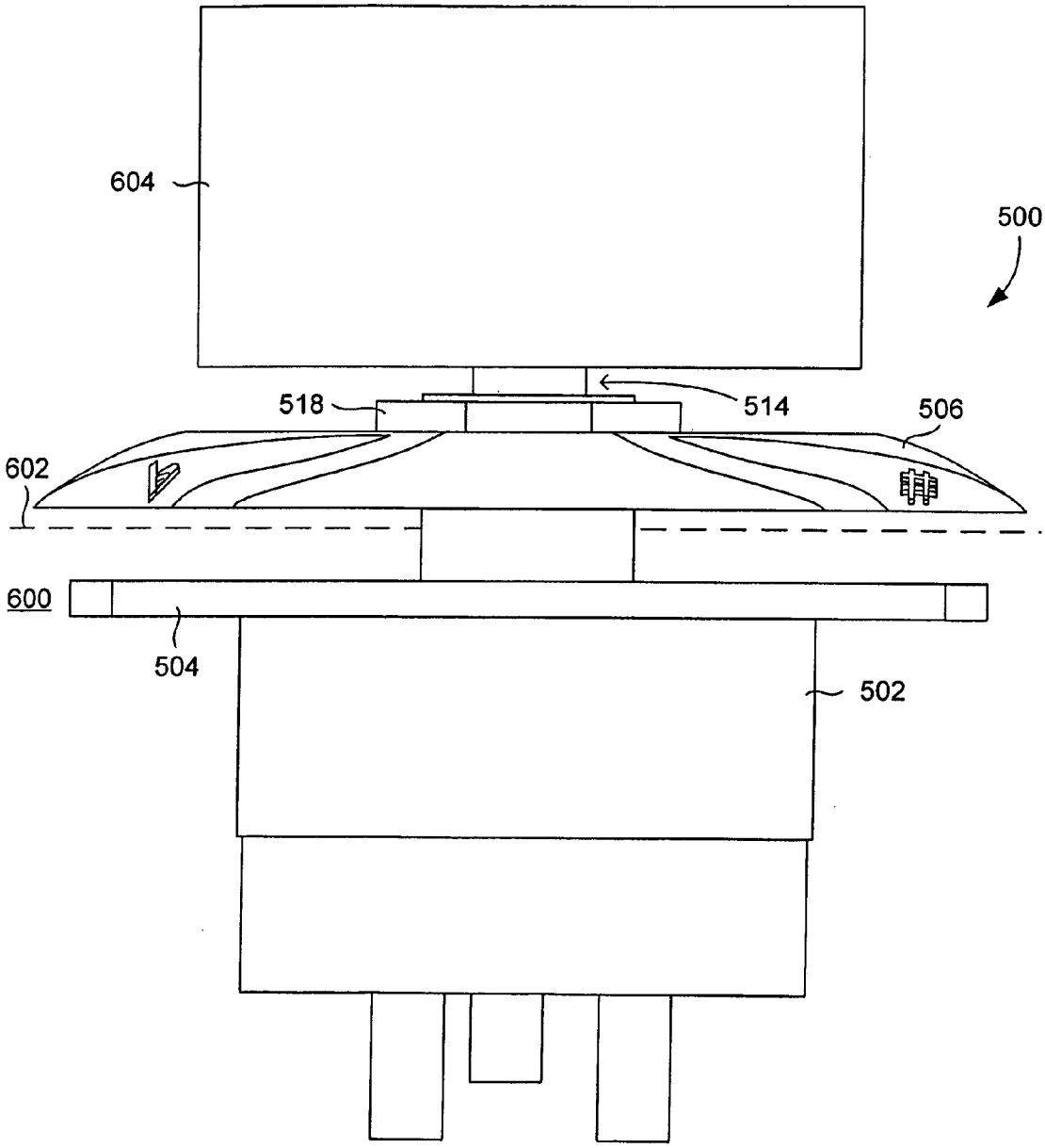
FIG. 6B shows a side view of a knob cap placed over the enhanced knob shown in FIG. 5A that represents one embodiment of the present invention.

FIG. 6A shows a side view of the enhanced knob shown in FIG. 5 that represents one embodiment of the present invention. FIG. 6B shows a side view of a knob cap placed over the enhanced knob shown in FIG. 6A that represents one embodiment of the present invention. When the enhanced knob 500 is placed in an instrument 600, the stem 514 of the pot 502 extends outward from the front surface 602 of the instrument 600, shown as a dashed line in FIG. 6B. The display ring 506, the nut 518, and a knob cap 604 interconnect to the stem 514 and are external to the front surface 602 of the instrument 600. The knob cap 604 may be used by a user to make adjustments using the enhanced knob 500. Additionally, in one embodiment of the present invention, the display ring 506 may be used as a display to show information which a user may use to aid the user in tuning the instrument 600.

Figure 7A:
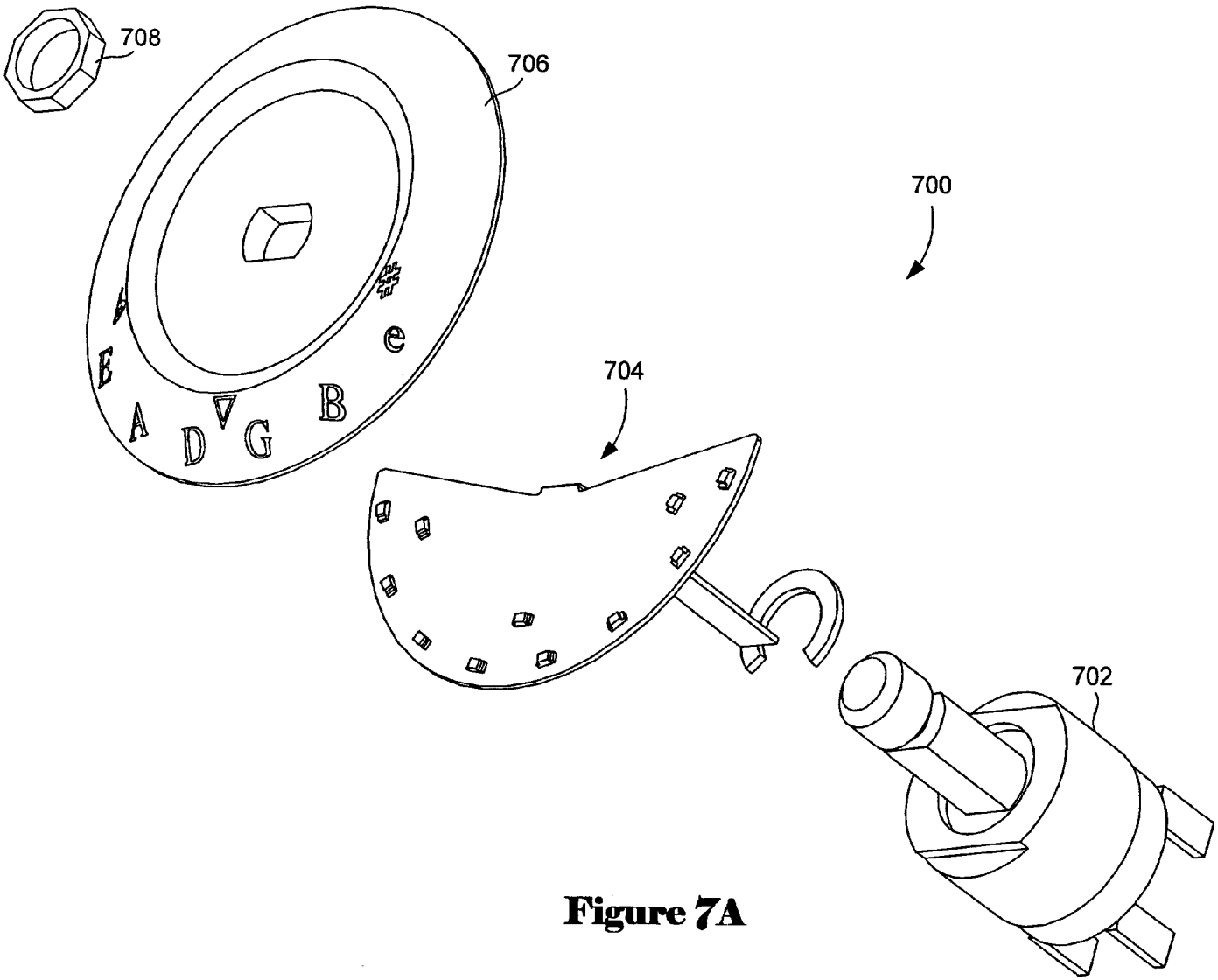
FIG. 7A shows a front, exploded view of an enhanced knob that represents one embodiment of the present invention.
Figure 7B:
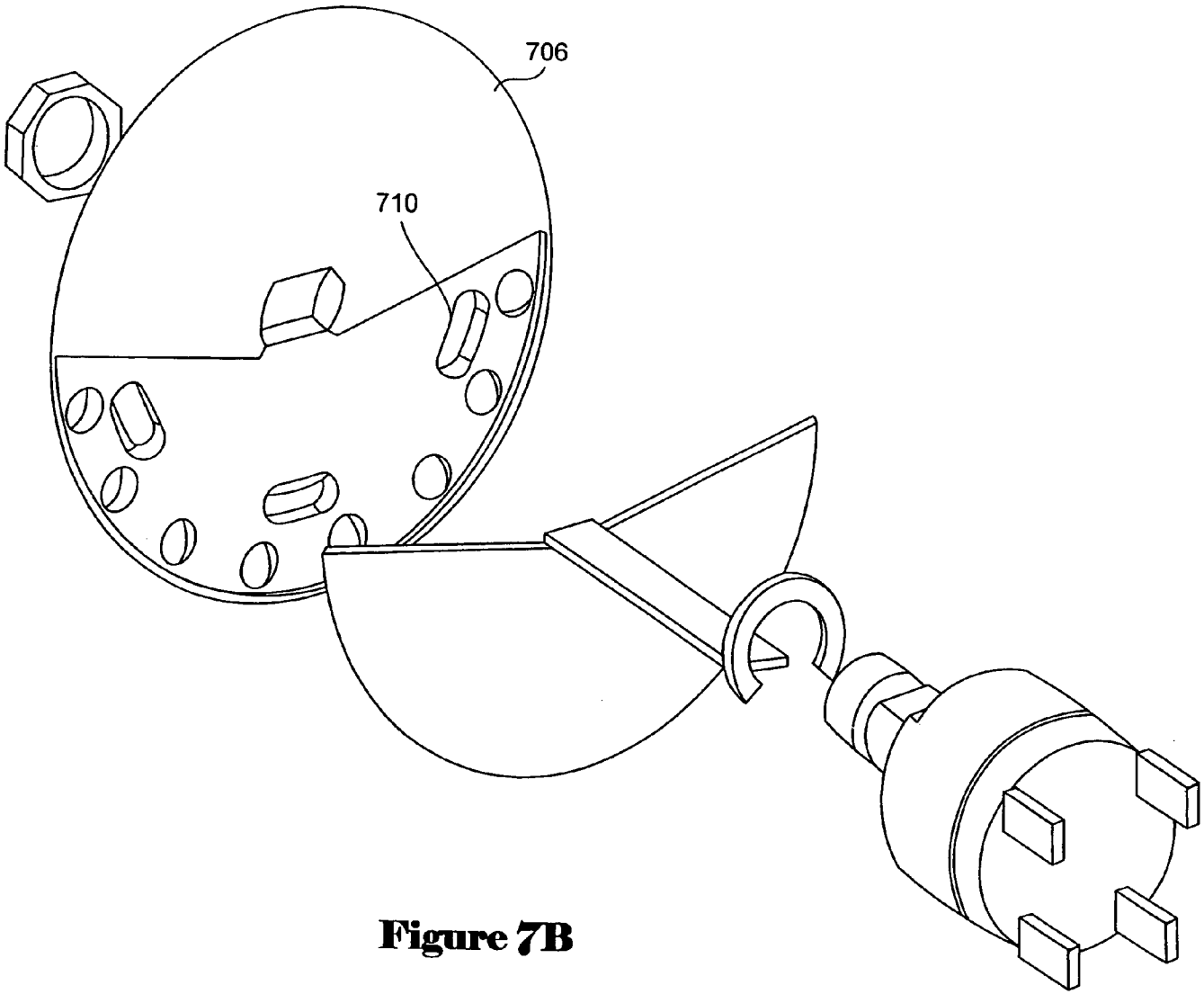
FIG. 7B shows a rear, exploded view of the enhanced knob shown in FIG. 7A that represents one embodiment of the present invention.

In FIGS. 6A-6B, a PCB is shown slid down the stem of the pot. However, a PCB can be fabricated without a mounting aperture and can be placed in other locations besides being sandwiched between a pot and a display ring. Instead, a PCB can be placed in electronic communication with an enhanced knob and positioned in proximity to the enhanced knob, either internal or external to an instrument. FIG. 7A shows a front, exploded view of an enhanced knob that represents one embodiment of the present invention. An enhanced knob 700 includes a pot 702, a number of LEDs 704 interconnected to an electronically-communicating means, a display ring 706, and a nut 708 to tighten the display ring 706 and the LEDs 704 to the pot 702. FIG. 7B shows a rear, exploded view of the enhanced knob shown in FIG. 7A that represents one embodiment of the present invention. The underside of the display ring 706 includes a number of depressions, such as depression 710, positioned to correspond to the number of LEDs 704 shown in FIG. 7A. Although FIGS. 7A-7B do not show a PCB as part of the enhanced knob 700 assembly, a PCB is in electronic communication with the pot 702 and the LEDs 704.

Figure 8:
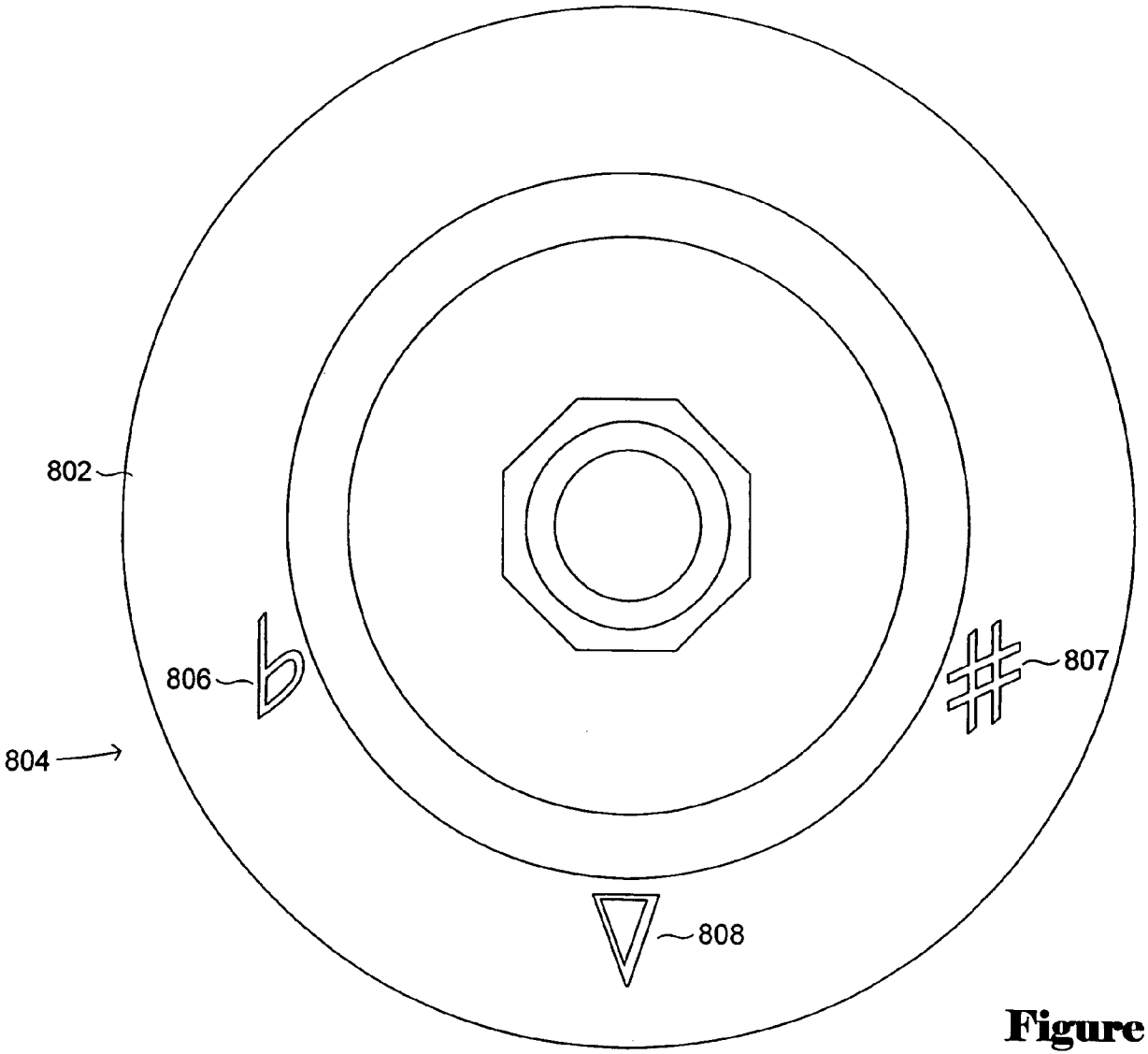
FIG. 8 shows an upside down, top view of a tuner display on a display ring for an enhanced knob that represents one embodiment of the present invention.

Various types of displays can be used for an enhanced knob, depending on the location of the display and the function of the enhanced knob. When an enhanced knob includes a tuner function, the enhanced knob indicates when a string on an instrument is sharp, flat, or in tune. In one embodiment of the present invention, a display is located on a display ring, such as the display rings shown in FIGS. 5-7B. A display ring can be fabricated from a clear, translucent, semi-translucent, or opaque material, such as plastic, through which an illuminated LED can be seen. FIG. 8 shows an upside down, top view of a tuner display on a display ring for an enhanced knob that represents one embodiment of the present invention. A display ring 802 contains a display 804 on one side of the display ring 802 that includes a marking of a "♭" symbol 806, a marking of a "♯" symbol 807, and a marking of an inverted isosceles-triangle symbol 808 on the outer surface of the display ring 802. Collectively, the "♭," "♯," and inverted isosceles-triangle markings are hereinafter referred to as the "directional" markings. The directional markings 806-808 can also be located inside or beneath the display ring 802 when the display ring 802 is fabricated from a material through which the directional markings 806-808 can be seen by a user while tuning an instrument. The directional markings 806-808 can be aligned with the LEDs (508-510 in FIG. 5). When the directional markings 806-808 are aligned with the LEDs (508-510 in FIG. 5), the tuner utilizes the illumination of the LEDs (508-510 in FIG. 5) underneath the display ring 802 to indicate whether a given played string on an instrument is sharp, flat, or in tune. For example, an illuminated LED underneath the "♭" marking 806 indicates that a played string is flat. Alternately, an illuminated LED underneath the "♯" marking 807 indicates that a played string is sharp, and an illuminated LED underneath the inverted isosceles-triangle marking 808 indicates that a played string is in tune.

In one embodiment of the present invention, a variable blink rate is used for the LEDs beneath the "♯" and "♭" markings on a display ring. The frequency of the blink rate is based on the distance in frequency of a played string from a desired frequency for the played string. For example, when a played string is a given distance below an in-tune frequency for the played string, the LED beneath the "♭" marking blinks at a given rate. As a user tightens the corresponding string and the string becomes more in tune, the LED beneath the "♭" marking blinks at a slower and slower rate until the frequency of the string matches the in-tune frequency and the LED beneath the "♭" marking ceases to blink. When the frequency of the played string matches the in-tune frequency, the LED beneath the "♭" marking ceases to illuminate and the LED beneath the inverted isosceles-triangle marking illuminates. In another embodiment of the present invention, the blinking rate increases as the frequency of the played string approaches the desired frequency.

In FIG. 8, and in several subsequent figures, displays on display rings are shown positioned for use when an enhanced knob is placed on an electric guitar. The displays are upside down and towards the top of the display rings so that the displays are visible right-side-up to a user wearing the electric guitar and viewing the enhanced knob from above. The position of a display on a display ring can be varied depending on the type of instrument being tuned and/or the placement of the enhanced knob on the instrument or amplifier. Note that the positioning of a knob cap does not affect the positioning of a display on a display ring because the display ring is fixed in position and stays stationary when a user rotates a knob cap.

Figure 9:
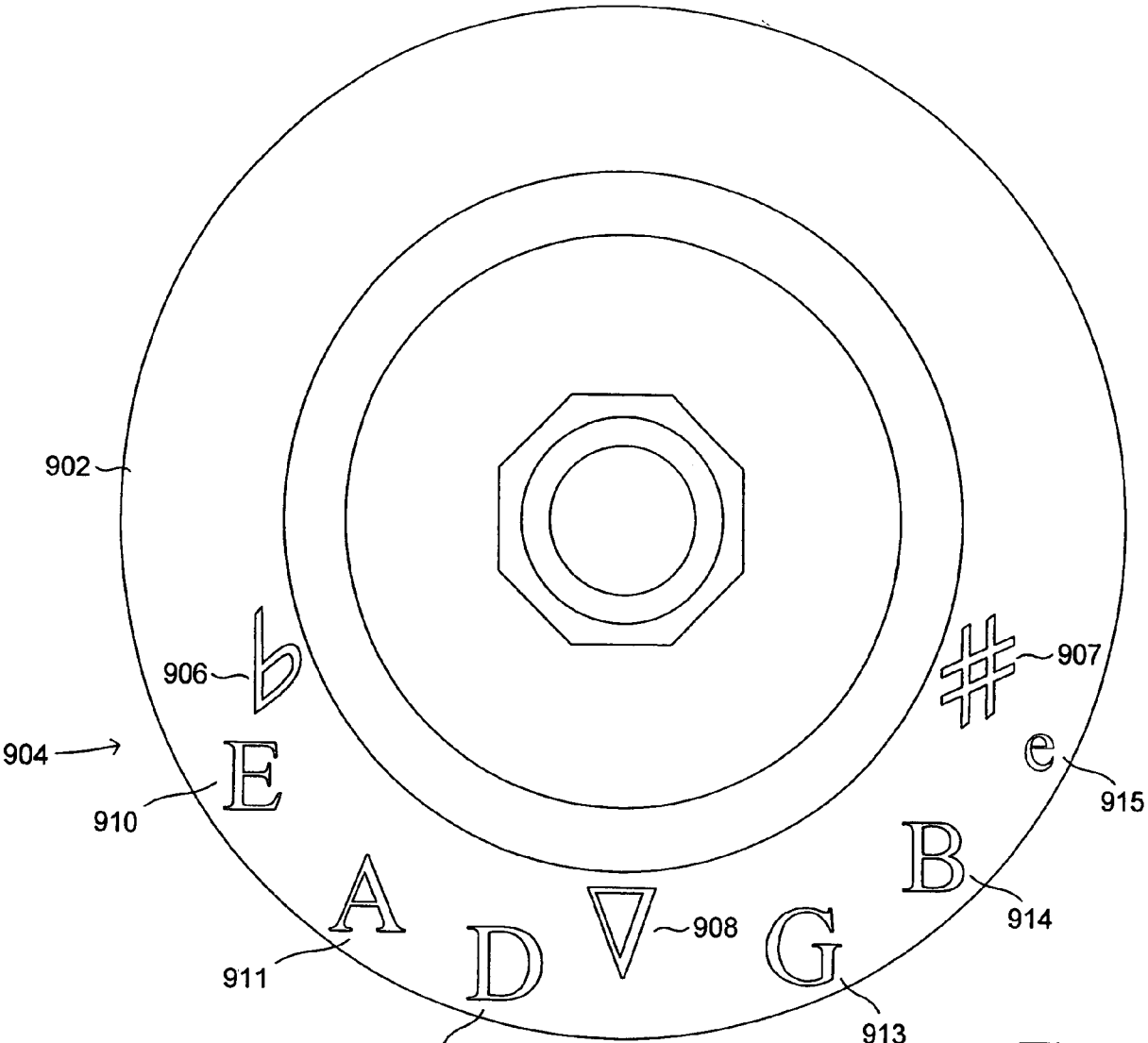
FIG. 9 shows an upside down, top view of a first guitar-tuner display on a display ring for an enhanced knob that represents one embodiment of the present invention.

FIG. 9 shows an upside down, top view of a first guitar-tuner display on a display ring for an enhanced knob that represents one embodiment of the present invention. A display ring 902 includes a guitar-tuner display 904 with directional markings 906-908 on, in, or beneath the display ring 902. Additionally, the guitar-tuner display 904 contains a marking for each of the strings on a standard six-string guitar: "E" 910, "A" 911, "D" 912, "G" 913, "B" 914, and "e" 915. Collectively, the markings representing the strings of an instrument are hereinafter referred to as the "string" markings. Each of the string markings 910-915 can be placed on, in, or beneath the display ring 902. A separate LED can be positioned beneath each of the string markings 910-915, as shown below, with reference to FIG. 10. During a tuning session, one of the LEDs beneath one of the string markings 910-915 illuminates to show the string being tuned. For example, when a user desires to tune the "G" string on an electric guitar equipped with an enhanced knob, the user switches the enhanced knob to the tuner function and plays the "G" string of the electric guitar. The LED beneath the "G" marking 913 on the display ring 902 illuminates. Additionally, when the "G" string is sharp, the LED beneath the "♯" marking 907 also illuminates. When the "G" string is flat, the LED beneath the "♭" marking 906 illuminates. When the "G" string is in tune, the LED beneath the inverted isosceles-triangle marking 908 illuminates.

Figure 10:
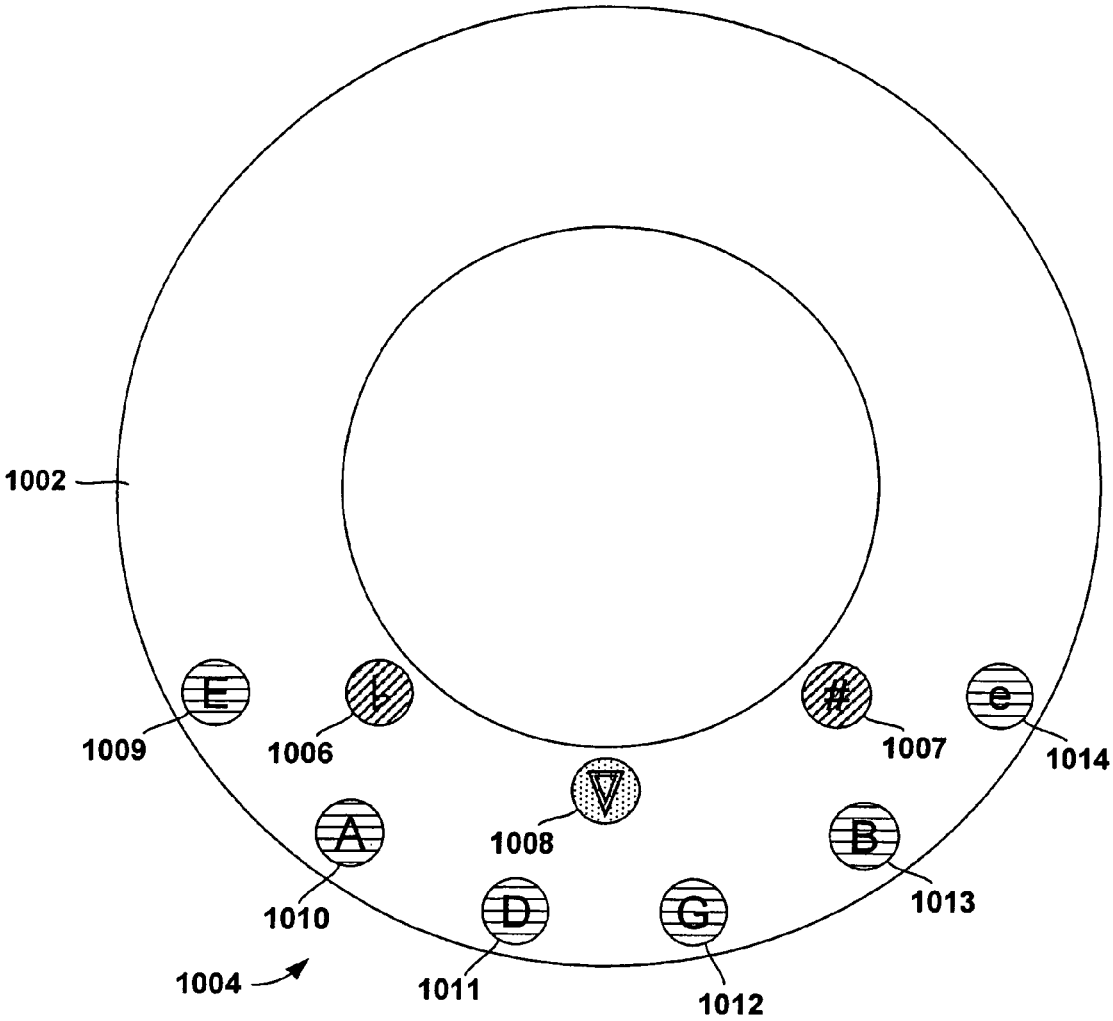
FIG. 10 shows an upside down, top view of a second guitar-tuner display on a display ring for an enhanced knob that represents one embodiment of the present invention.

FIG. 10 shows an upside down, top view of a second guitar-tuner display on a display ring for an enhanced knob that represents one embodiment of the present invention. A display ring 1002 includes a guitar-tuner display 1004. The guitar-tuner display 1004 contains one of three different colors of LEDs beneath each of the markings 1006-1014 on, in, or above the display ring 1002. An LED beneath a "♭" marking 1006 and an LED beneath a "♯" marking 1007 are a first color, such as red, as indicated by cross hatching. An LED beneath a marking of an inverted isosceles-triangle 1008 is a second color, such as green, as indicated by stippling, and a separate LED beneath the string markings of: an "E" 1009, an "A" 1010, a "D" 1011, a "G" 1012, a "B" 1013, and an "e" 1014 are a third color, such as amber, as indicated by horizontal lines. In alternate embodiments of the present invention, different color LEDs, or multi-colored LEDs are utilized. LEDs of varying sizes and intensities can be used as well.

Figure 11:
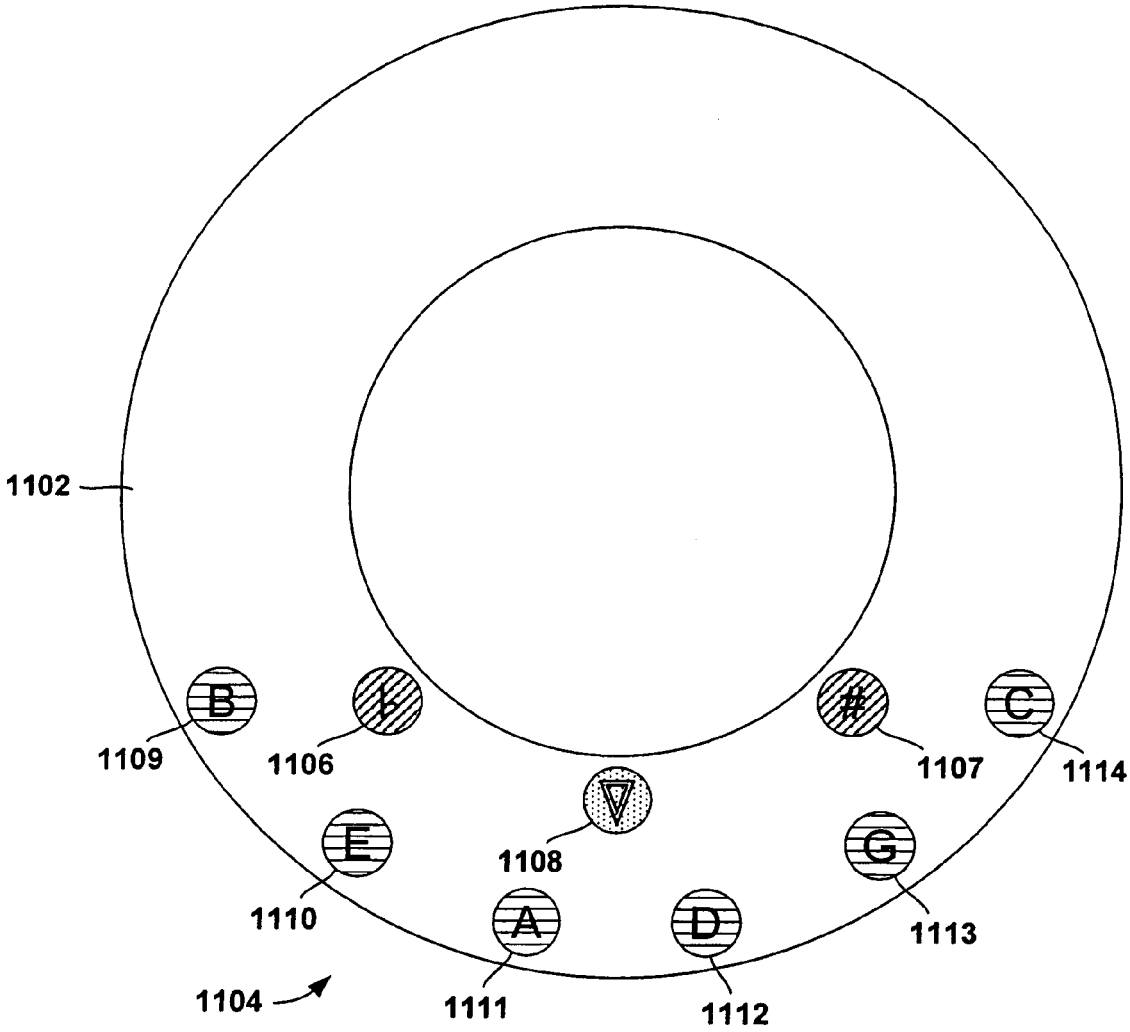
FIG. 11 shows an upside down, top view of a bass-tuner display on a display ring for an enhanced knob that represents one embodiment of the present invention.

In alternate embodiments of the present invention, the string markings vary in number and in note letters in order to accommodate various types of instruments, including three-string electric balalaikas, four-string electric ukuleles, five-string electric banjos, eight-string electric mandolins, forty-six string electric pedal harps, and other electric stringed musical instruments. FIG. 11 shows an upside down, top view of a bass-tuner display on a display ring for an enhanced knob that represents one embodiment of the present invention. A display ring 1102 includes a bass-tuner display 1104. The bass-tuner display 1104 is similar to the guitar-tuner display 1002 discussed above, with reference to FIG. 10. The bass-tuner display 1104 contains LEDs of a first color beneath a "♭" marking 1106 and a "♯" marking 1107, and one or more LEDs of a second color beneath an inverted isosceles-triangle marking 1108. However, the bass-tuner display 1104 is designed for use with a six-string electric bass and includes string markings 1109-1114 of a third color corresponding to the strings on a six-string electric bass.

Figure 12:
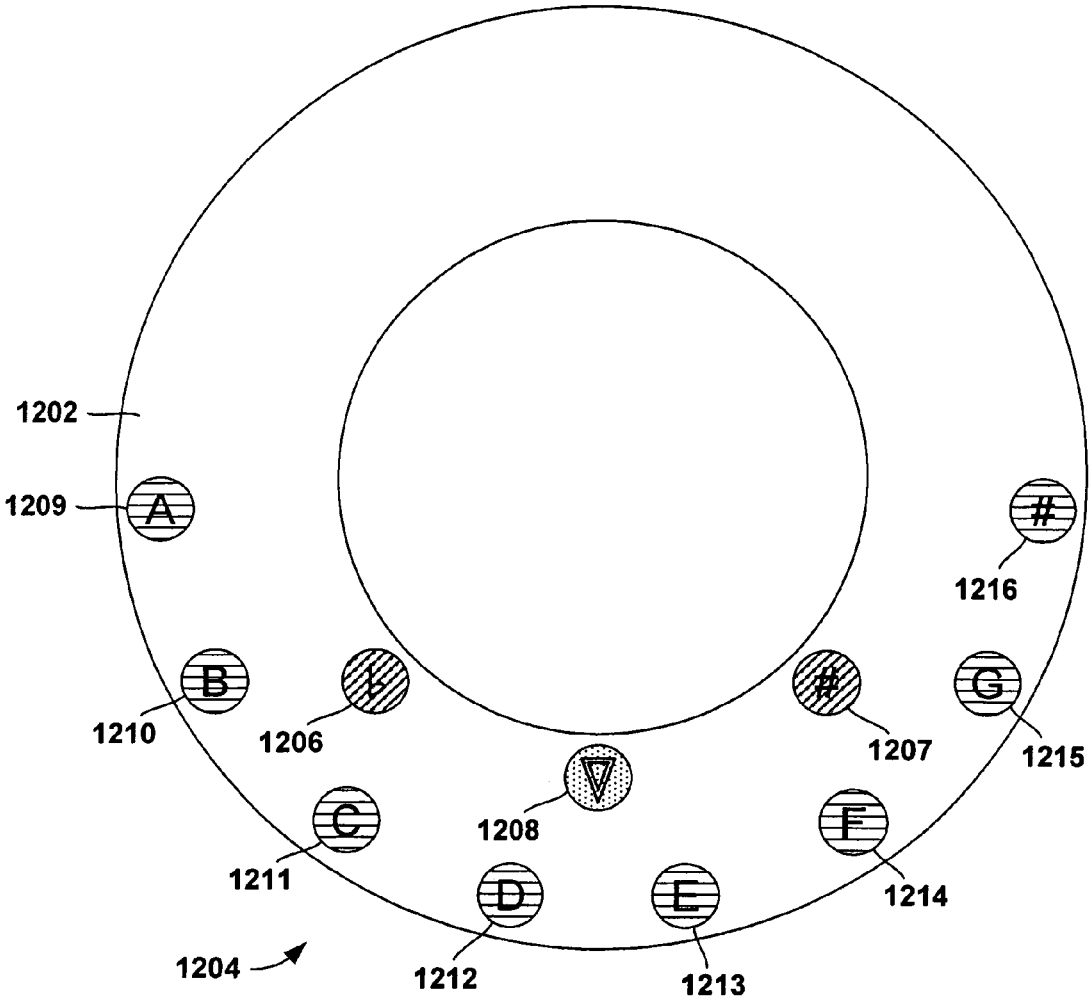
FIG. 12 shows an upside down, top view of a chromatic-tuner display on a display ring for an enhanced knob that represents one embodiment of the present invention.

In one embodiment of the present invention, an enhanced knob utilizes markings for notes on a chromatic scale instead of strings on an instrument. FIG. 12 shows an upside down, top view of a chromatic-tuner display on a display ring for an enhanced knob that represents one embodiment of the present invention. A display ring 1202 includes a chromatic-tuner display 1204. The chromatic-tuner display 1204 contains LEDs of a first color beneath a "♭" marking 1206 and a "♯" marking 1207, and one or more LEDs of a second color beneath an inverted-isosceles-triangle marking 1208. However, instead of including markings corresponding to the strings on an instrument, the chromatic-tuner display 1104 contains "chromatic-scale" markings for each of the notes in a chromatic scale. The notes on a standard twelve-note chromatic scale include: "A," "A♯/B♭," "B," "C," "C♯/D♭," "D," "D♯/E♭," "E," "F," "F♯/G♭," "G," and "G♯/A♭."

In one embodiment of the present invention, the chromatic-tuner display 1204 reduces the number of chromatic-scale markings by including markings above LEDs of a third color for each of the whole notes "A" 1209, "B" 1210, "C" 1211, "D" 1212, "E" 1213, "F" 1214, and "G" 1215 in a chromatic scale, and a "♯" marking 1216. The chromatic-scale whole notes 1209-1215 and the "♯" marking 1216 can be used in tandem to display the nearest note in a chromatic scale to the note being played on an instrument. A user can play a note on an instrument and look at the chromatic-scale markings 1209-1216 to see the nearest chromatic-scale note to the note being played, and then look at the directional markings 1206-1208 to see whether the note being played in sharp, flat, or in tune with the nearest chromatic-scale note. For example, when a user desires to tune a given string on an electric guitar to a "C," the user plays a "C" on the electric guitar. An LED illuminates beneath the "C" marking 1211 on the chromatic-tuner display 1204. Additionally, one of the directional markings 1206-1208 illuminates to show whether the played note is sharp, flat, or in tune with "C." When a user desires to tune a given string, for example, to a "C♯/D♭," the LEDs beneath the "C" marking 1214 and the "♯" symbol 1216 both illuminate. Additionally, one of the directional markings 1206-1208 illuminates to show whether the played note is sharp, flat, or in tune with the frequency for a "C♯/D♭." A user can use the chromatic-tuner display 1204 to aid the user in performing alternate string tunings for an instrument. For example, a user can use the chromatic-tuner display 1204 to perform a "drop D" tuning on an electric guitar so that the "e" string is dropped down to the frequency of a "D." A user can also use the chromatic-tuner display to perform other alternate tunings, such as "open G" tuning, "low C" tuning, and other alternate tunings.

Figure 13:
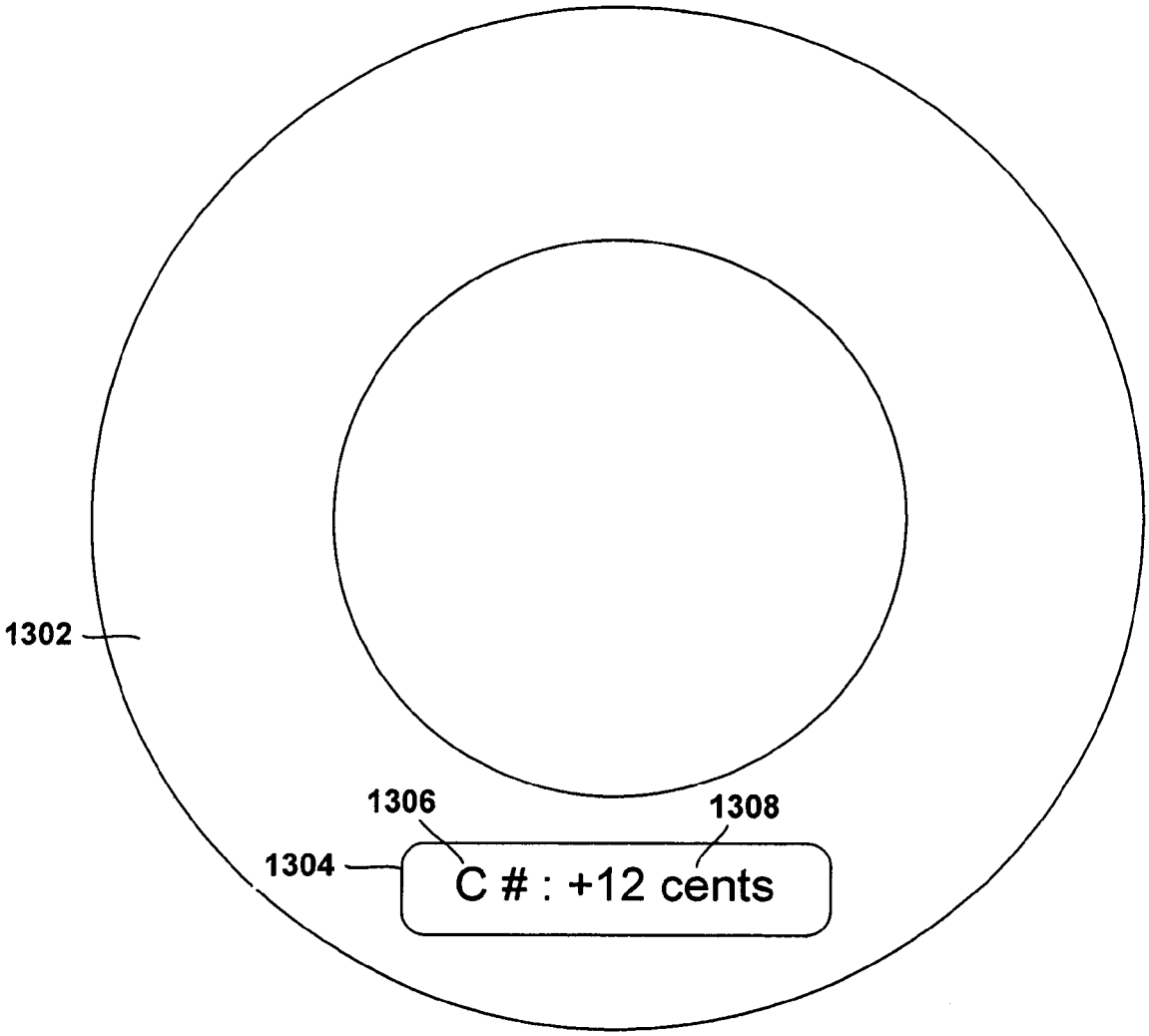
FIG. 13 shows an upside down, top view of a liquid crystal display on a display ring for an enhanced knob that represents one embodiment of the present invention.

FIG. 13 shows an upside down, top view of a liquid crystal display on a display ring for an enhanced knob that represents one embodiment of the present invention. A display ring 1302 includes a display containing letters and/or numbers, such as a liquid crystal display 1304 ("LCD"). The LCD 1304 shows the nearest chromatic-scale note 1306 to the note being played by a user. Additionally, the LCD 1304 shows the distance in frequency 1308 the played string is from the nearest chromatic-scale note 1306. In FIG. 13, the nearest chromatic-scale note 1306 is shown as "C♯," and the played string is currently twelve cents above "C♯." In alternate embodiments of the present invention, different types of displays containing letters and/or numbers can be used instead of LCDs to show the nearest chromatic-scale note 1306 and the distance in frequency 1308 of the played string to the nearest chromatic-scale note 1306, including vacuum fluorescent displays, organic LED displays, dot matrix displays, seven-segment LED displays, and other types of displays suitable for containing letters and/or numbers. Additionally, LCDs can be used in combination with LEDs. For example, an LCD can be used to show a letter representing the nearest standard-scale note being played and directional LEDs can be used to indicate whether the string being played is sharp, flat, or in tune.

Figure 14:
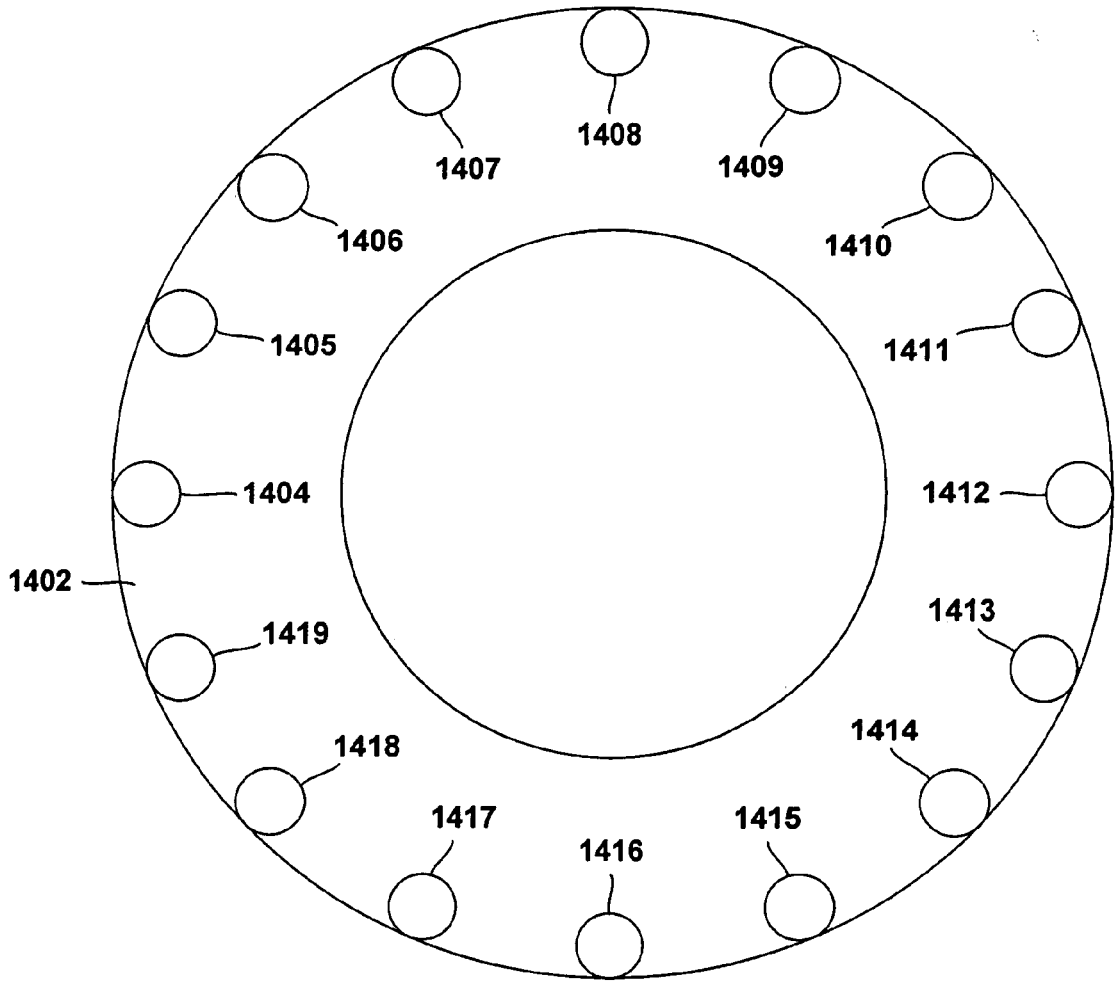
FIG. 14 shows a top view of a strobe-ring display on a display ring for an enhanced knob that represents one embodiment of the present invention.

FIG. 14 shows a top view of a strobe-ring display on a display ring for an enhanced knob that represents one embodiment of the present invention. A display ring 1402 includes a ring of sixteen LEDs 1404-1419 around the perimeter of the display ring 1402. When a user plays a string on an instrument while the enhanced knob is switched to the tuner function, the LEDs 1404-1419 can be used to determine whether the played string is sharp, flat, or in tune. In one embodiment of the present invention, the LEDs flash in a temporally staggered manner, such that each LED flashes before a neighboring LED on one side and after a neighboring LED on the other side to create a "chasing" effect. The direction of the "chase" can be used to indicate whether the played string is sharp or flat. The speed of the "chase" can be used to indicate the magnitude of the sharpness or the flatness. For example, a counterclockwise "chase" may indicate that the played string is sharp and a clockwise "chase" may indicate that the played string is flat. As a user turns a corresponding tuning peg to loosen the string, the string becomes more in tune. Consequently, the velocity of the "chase" decreases until the "chase" appears to cease, thus indicating that the string is in tune. In an alternate embodiment of the present invention, the velocity of the "chase" increases as a string becomes more in tune. Although FIG. 14 shows sixteen LEDs 1404-1419 around the perimeter of the display ring 1402, a variable number of LEDs can be used. Additionally, LEDs of varying colors and intensities can be used as well.

Each of the displays discussed above, with reference to FIGS. 8-14, utilizes a display ring. In alternate embodiments of the present invention, various displays are utilized that do not incorporate display rings. In one embodiment of the present invention, one or more light pipes are drilled into the body (106 in FIG. 1) of an instrument and/or an amplifier. Various different displays, such as LEDs and display containing letters and/or numbers, can be placed within the one or more light pipes and can be used to indicate whether a string is sharp, flat, or in tune. The one or more light pipes can be angled so that the display is only visible from a narrow range of angles, including the viewing angles most commonly used by a user. In another embodiment of the present invention, a pop-out display is utilized. The pop-out display is mounted inside an instrument and/or amplifier and is visible to a user when a user depresses a knob, latch, or other element. The pop-out display can be angled so that the display is only visible from a narrow range of angles, including the viewing angles most commonly used by a user.

Figure 15:
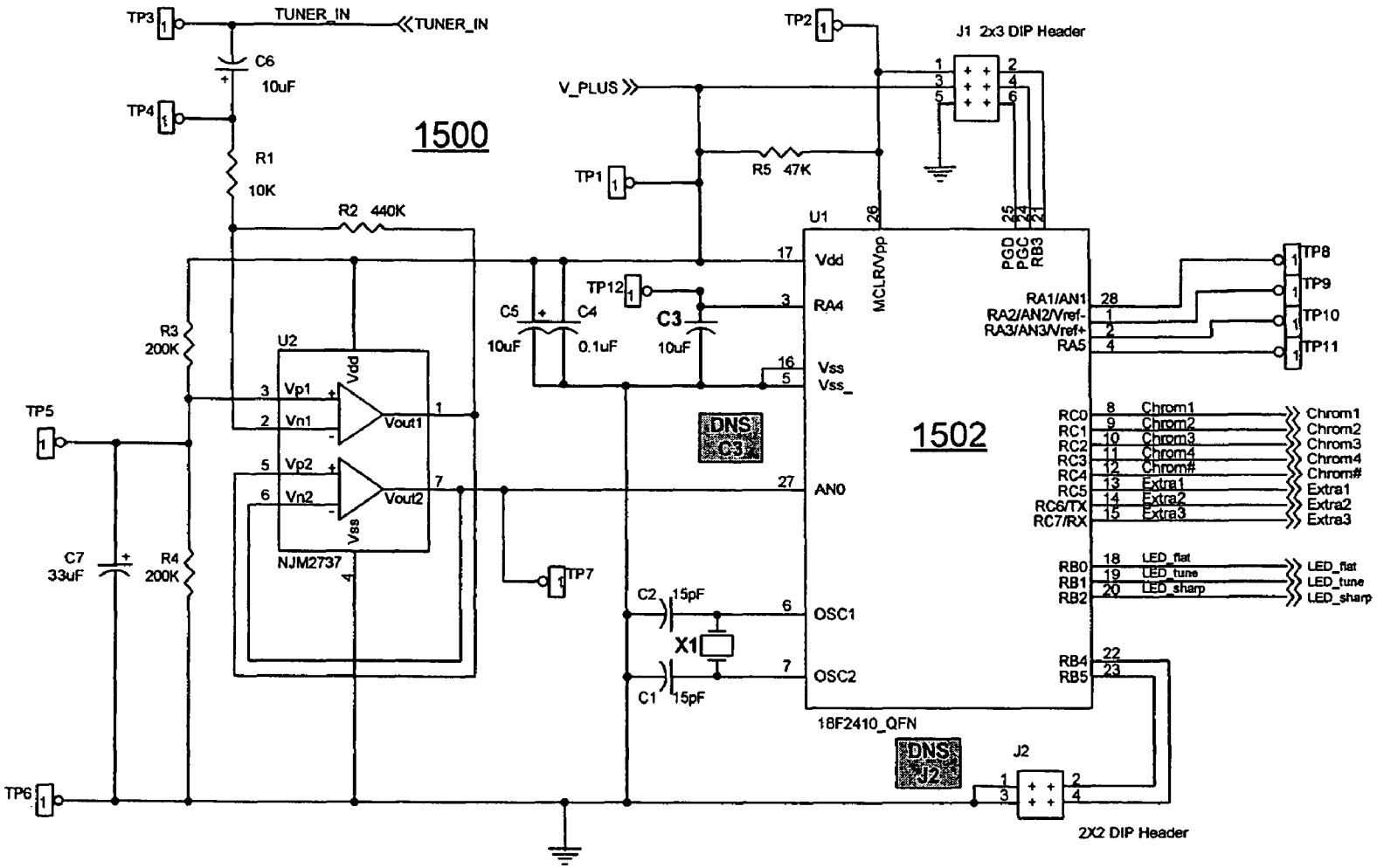
FIG. 15 shows a schematic diagram of a tuner circuit for an enhanced knob that represents one embodiment of the present invention.

FIG. 15 shows a schematic diagram of a tuner circuit for an enhanced knob that represents one embodiment of the present invention. A tuner circuit 1500 includes a processor 1502 programmed with an algorithm that determines the fundamental frequency of an input signal from a vibrating string and compares the frequency of the input signal to the nearest stored tone. Note that stored tones can be standard-scale tones or other tones, such as a reference tone that is, for example, fifty hertz above a standard-scale tone. The frequencies of the stored tones utilized by the processor 1502 can vary depending on what type of instrument is being tuned and what type of display is being utilized. For example, a guitar-tuner display for an electric guitar and a bass-tuner display for a six-string electric bass may both include six tones stored in the processor 1502 corresponding to the six strings. However, the frequencies of stored tones may be different for an electric guitar than for a six-string electric bass. A chromatic-tuner display may have twelve tones stored in the processor 1502 corresponding to the twelve notes in a standard chromatic scale.

In one embodiment of the present invention, the processor 1502 includes an analog-to-digital converter that converts an analog input signal to a digital signal and counts the zero crossings of the digital signal to determine the fundamental frequency of the input signal. In an alternate embodiment of the present invention, a Schmitt trigger is used to count zero crossings. In other alternate embodiments of the present invention, different methods of determining the fundamental frequency of input signals are utilized, such as integer Fourier transforms, floating point Fourier transforms, and other fundamental-frequency-determining methods. The processor 1502 determines whether the input signal is within a predetermined threshold range above and below any of the stored tones. When the input signal is within the predetermined threshold range of a stored tone, the vibrating string is considered to be in tune with the stored tone. When the input signal is higher than the predetermined threshold value above the nearest stored tone, the vibrating string is considered to be sharp. When the input signal is lower than the predetermined threshold value below the nearest stored tone, the vibrating string is considered to be flat. The results of the comparison are output to a display, such as one of the displays discussed above, with reference to FIGS. 8-14.

Figure 16A:
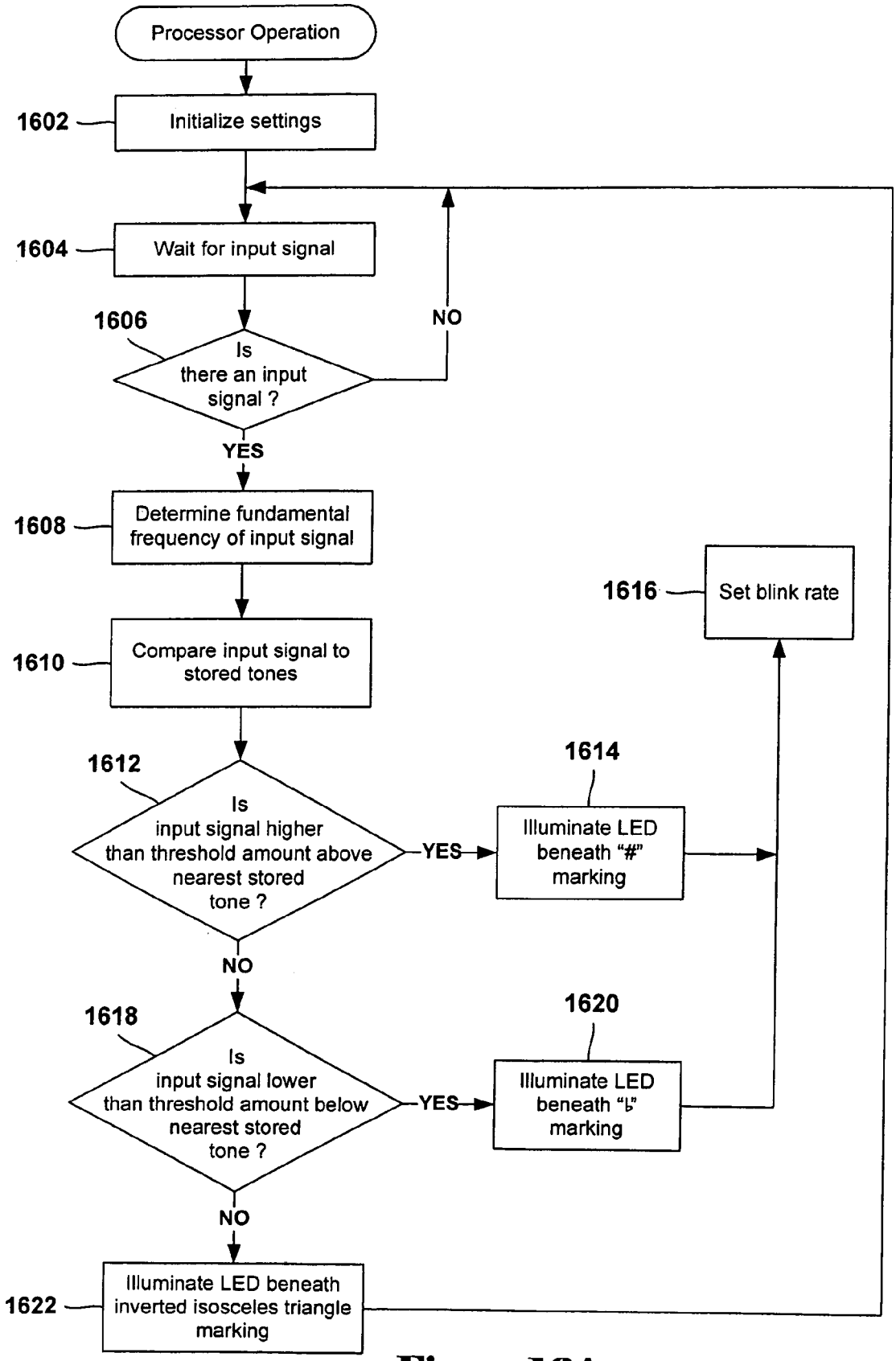
FIG. 16A shows a control-flow diagram for a tuning operation by a processor in an enhanced knob that represents one embodiment of the present invention.

FIG. 16A shows a control-flow diagram for a tuning operation by a processor in an enhanced knob that represents one embodiment of the present invention. In step 1602, the processor settings are initialized. In step 1604, the processor waits for an input signal. When, in step 1606, there is not an input signal, control is passed back to step 1604. Otherwise, in step 1608, the processor determines the fundamental frequency of the input signal. In step 1610, the processor determines the nearest stored tone by comparing the frequency of the input signal to the frequencies of the stored tones. When, in step 1612, the input signal is higher than the nearest stored tone by more than a predetermined threshold amount, control is passed to step 1614 and the LED beneath the "♯" marking is illuminated. Once the LED beneath the "♯" marking is illuminated in step 1614, control is passed to step 1616 and a blink rate for the illuminated LED is determined based on the distance in frequency of the input signal to the nearest stored tone. When, in step 1612, the input signal is not a predetermined threshold amount above the nearest stored tone, control is passed to step 1618. When, in step 1618, the input signal is lower than the nearest stored tone by more than a predetermined threshold amount, control is passed to step 1620 and the LED beneath the "♭" marking is illuminated. Once the LED beneath the "♭" marking is illuminated in step 1620, control is passed to step 1616 and a blink rate for the illuminated LED is determined. When, in step 1618, the input signal is not a predetermined threshold amount below the nearest stored tone, control is passed to step 1622 and the LED beneath the inverted-isosceles-triangle marking is illuminated for a predetermined length of time and control is passed back to step 1604. In an alternate embodiment of the present invention, the LED beneath the inverted-isosceles triangle marking remains illuminated until the strength of the input signal drops beneath a threshold reception value.

Figure 16B:
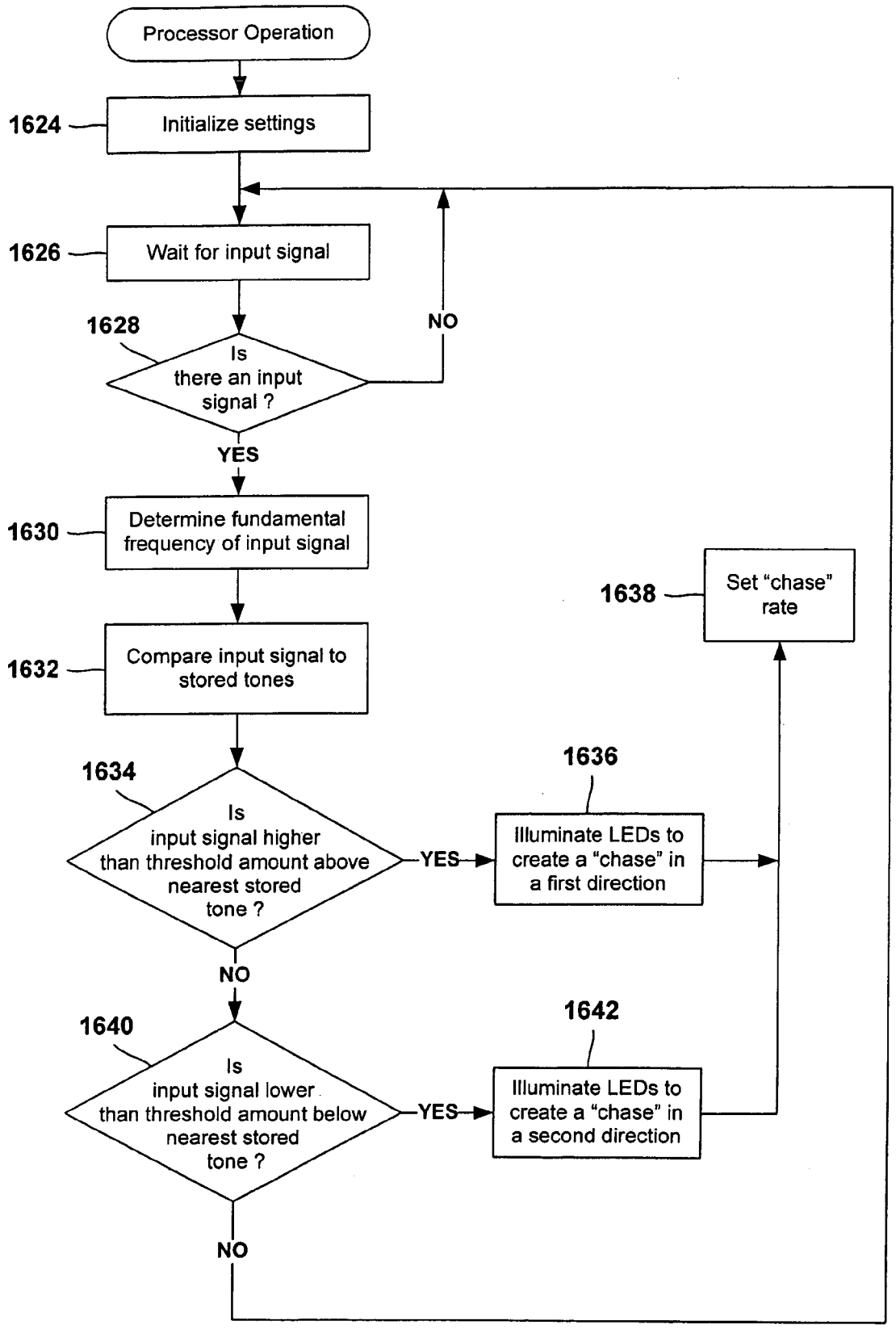
FIG. 16B shows a control-flow diagram for a tuning operation by a processor in an enhanced knob with a strobe-ring display that represents one embodiment of the present invention.

FIG. 16B shows a control-flow diagram for a tuning operation by a processor in an enhanced knob with a strobe-ring display that represents one embodiment of the present invention. In step 1624, the processor settings are initialized. In step 1626, the processor waits for an input signal. When, in step 1628, there is not an input signal, control is passed back to step 1626. Otherwise, in step 1630, the processor determines the fundamental frequency of the input signal. In step 1632, the processor determines the nearest stored tone by comparing the frequency of the input signal to the frequencies of the stored tones. When, in step 1634, the input signal is higher than the nearest stored tone by more than a predetermined threshold amount, control is passed to step 1636 and a ring of LEDs are repeatedly instructed to flash to create a "chase" in a first direction. Once the ring of LEDs are instructed to flash in step 1636, control is passed to step 1638 and a "chase" rate for the flashing LEDs is determined based on the distance in frequency of the input signal to the nearest stored tone. When, in step 1634, the input signal is not a predetermined threshold amount above the nearest stored tone, control is passed to step 1640. When, in step 1640, the input signal is lower than the nearest stored tone by more than a predetermined threshold amount, control is passed to step 1642 and the ring of LEDs are repeatedly instructed to flash to create a "chase" in a second direction. Once the ring of LEDs are instructed to flash in step 1642, control is passed to step 1638 and a "chase" rate for the flashing LEDs is determined based on the distance in frequency of the input signal to the nearest stored tone. When, in step 1640, the input signal is not a predetermined threshold amount below the nearest stored tone, control is passed back to step 1626.

Figure 17:
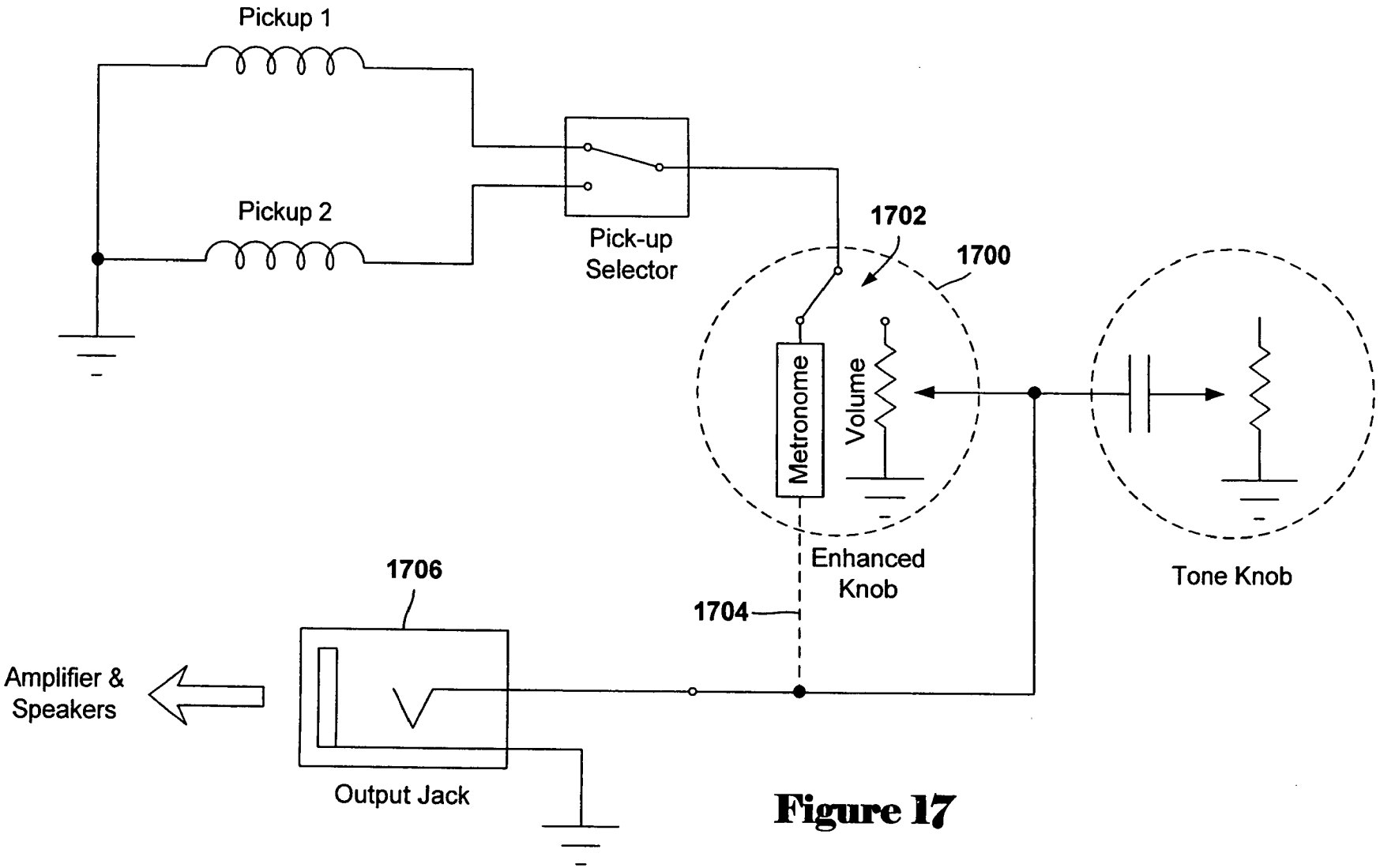
FIG. 17 shows a schematic diagram of an instrument circuit with a volume knob replaced with an enhanced knob with a metronome function that represents one embodiment of the present invention.

In one embodiment of the present invention, the volume knob for an instrument is replaced with an enhanced knob that includes a volume function and a metronome function. The metronome function may be used to establish a tempo with which to play along with an instrument. The tempo is established by creating a series of timed, reoccurring beats. FIG. 17 shows a schematic diagram of an instrument circuit with a volume knob replaced with an enhanced knob with a metronome function that represents one embodiment of the present invention. In FIG. 17, an enhanced knob 1700 is shown as a dashed circle surrounding a volume function and a metronome function. The enhanced knob 1700 includes a switch 1702 for switching between the volume function and the metronome function. Both the volume function and the metronome function are user controlled. Thus, a user can use the enhanced knob 1700 to select and control the volume function or to switch to the metronome function and use the enhanced knob 1700 to select a beat with which to play along. As described above, with reference to FIGS. 4A and 4B, in alternate embodiments of the present invention the enhanced knob may, instead, replace a knob on an amplifier, or be an add-on feature for either an instrument or an amplifier.

Once the metronome function is selected, a user can select the desired beats per minute ("BPM"). In one embodiment of the present invention, the beats are aurally indicated to a user as repeating signals generated by an enhanced knob and output to an interconnected amplifier as repeating audio signals. Dashed line 1704 indicates that the metronome function can be placed in electronic communication with an output jack 1706 so that a selected number of BPM can be output to an amplifier and interconnected speaker. Various different audio sounds can be output, including chimes, clicks, claves, ticks, chings, tocks, and other audio sounds. Additionally, the volume of the output audio signals can be adjusted so that a user can hear the beats at a sound level appropriate for the sound level of the music being played with an instrument.

Figure 18:
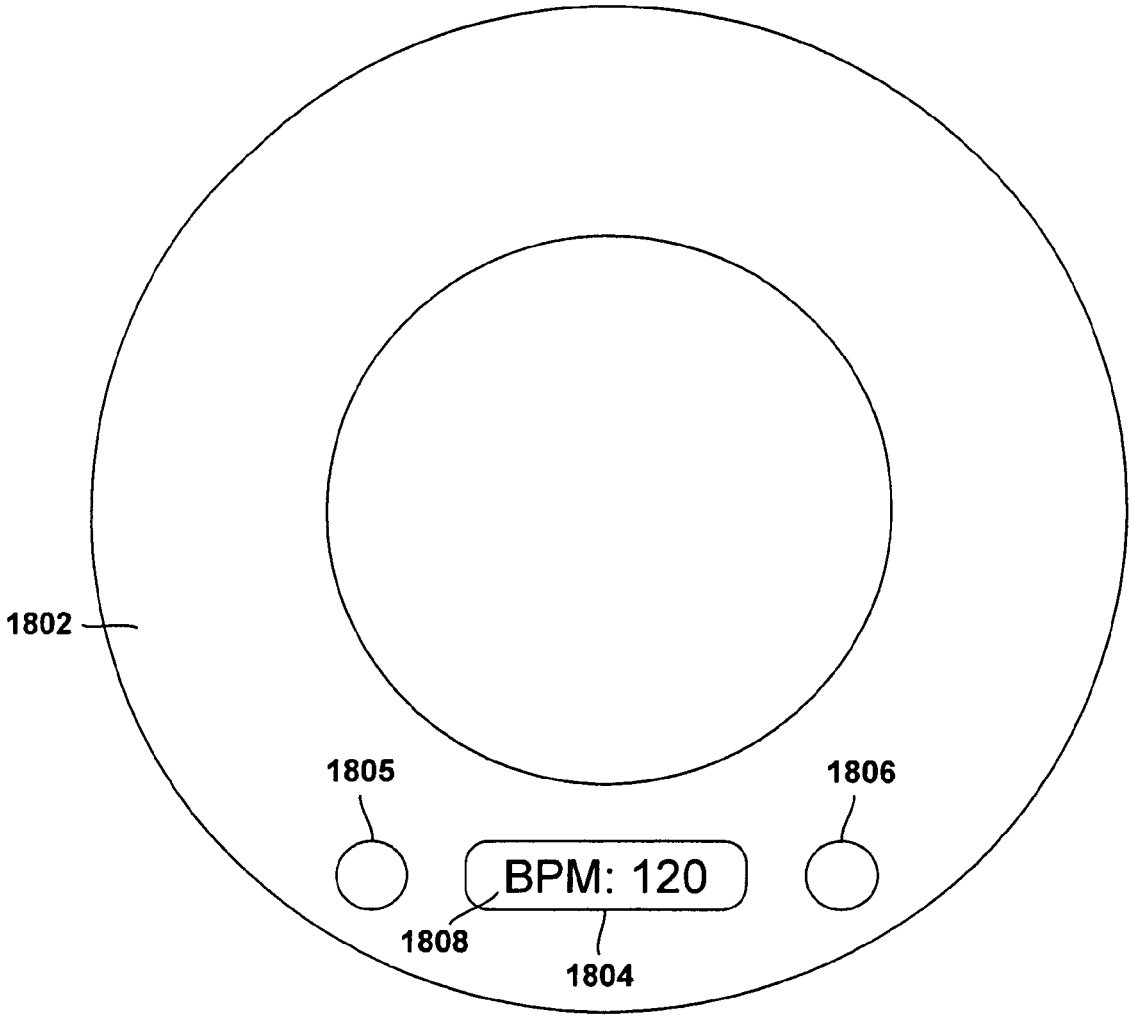
FIG. 18 shows an upside down, top view of a first metronome display on a display ring for an enhanced knob that represents one embodiment of the present invention.

In another embodiment of the present invention, a visual display is used to visually indicate the occurrence of each beat. In alternate embodiments of the present invention, beats are indicated by audible signals, visual signals, or both audible signals and visual signals. FIG. 18 shows an upside down, top view of a first metronome display on a display ring for an enhanced knob that represents one embodiment of the present invention. A display ring 1802 includes a display containing letters and/or numbers, such as an LCD 1804, and two LEDs 1805 and 1806 flanking the LCD 1804. The LCD 1804 shows a selected number of BPM 1808. In FIG. 18, "120 BPM" has been selected. When a number of BPM has been selected, the LEDs 1805 and 1806 each illuminate on each beat for a predetermined length of time. In alternate embodiments of the present invention, the LEDs 1805 and 1806 alternate illuminating on each beat. For example, on the first beat the LED 1805 illuminates and the LED 1806 remains off, and on the second beat the LED 1806 illuminates and the LED 1805 remains off. Although LCDs are shown in FIG. 18 and in later figures, in alternate embodiments of the present invention, different types of displays containing letters and/or numbers can be used instead of LCDs, including vacuum fluorescent displays, organic LED displays, dot matrix displays, seven-segment LED displays, and other types of displays suitable for displaying letters and/or numbers.

Figure 19:
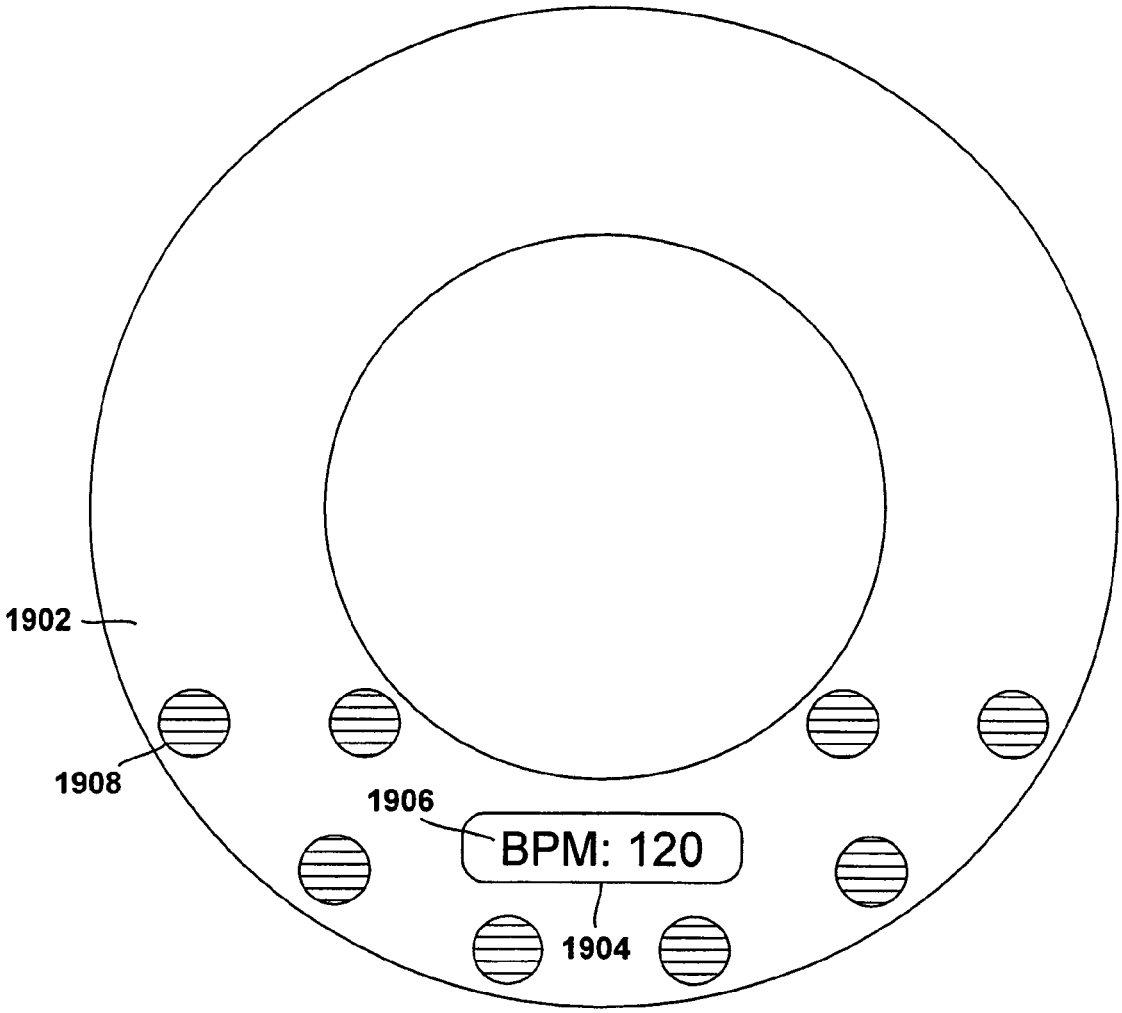
FIG. 19 shows an upside down, top view of a second metronome display on a display ring for an enhanced knob that represents one embodiment of the present invention.

FIG. 19 shows an upside down, top view of a second metronome display on a display ring for an enhanced knob that represents one embodiment of the present invention. A display ring 1902 includes a display containing letters and/or numbers, such as an LCD 1904, showing a selected number of BPM 1906 and eight LEDs, such as LED 1908, in the proximity of the LCD 1904. The LEDs are shown arranged similarly to the LEDs described above, with reference to the display rings 1002 and 1102 shown in FIGS. 10 and 11, respectively. The LEDs shown in FIG. 19 are shown with similar horizontal lines to indicate that the LEDs are each the same color. However, multiple colors can be used. Additionally, LEDs of varying sizes and intensities can be used. When a number of BPM has been selected, the LEDs shown in FIG. 19 each illuminate on each beat for a predetermined length of time. In alternate embodiments of the present invention, the LEDs on a first side illuminate on even beats and the LEDs on a second side illuminate on odd beats.

Figure 20:
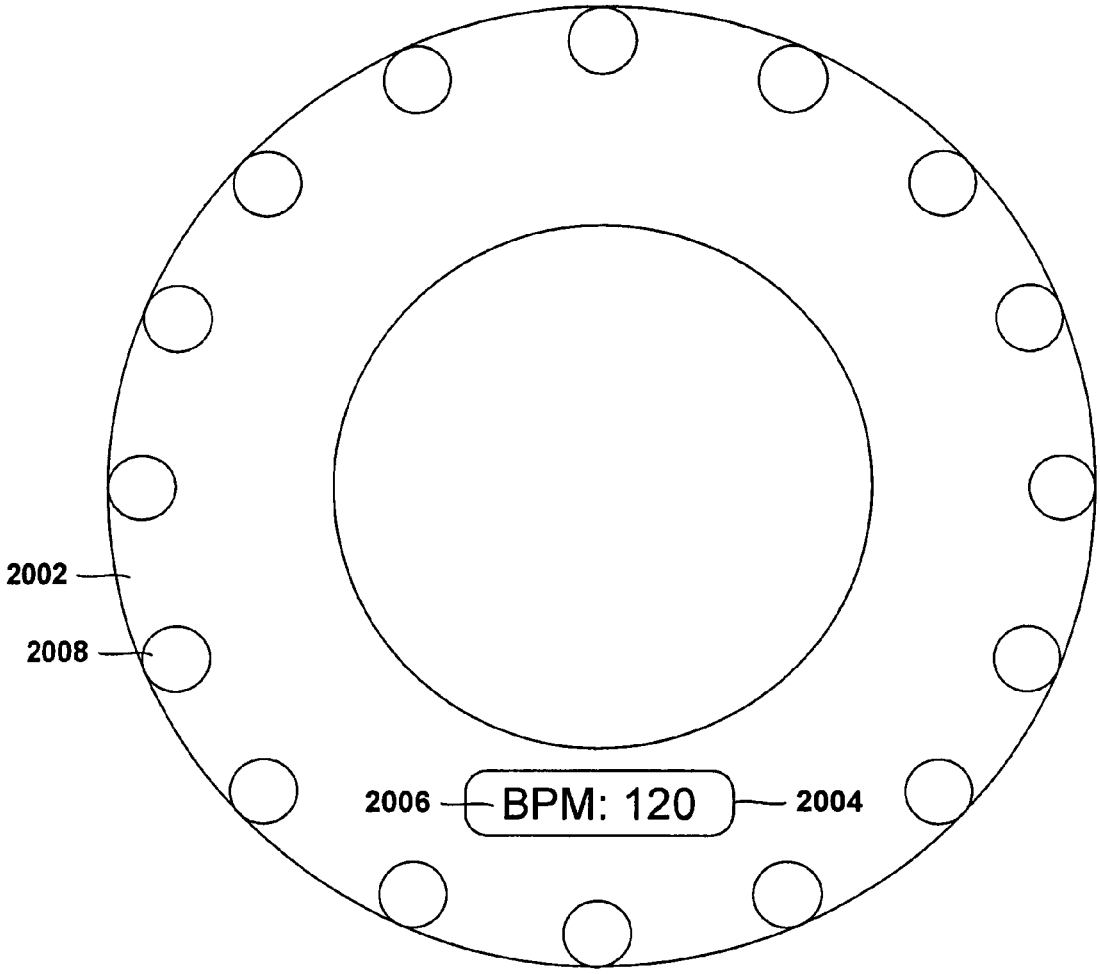
FIG. 20 shows an upside down, top view of a third metronome display on a display ring for an enhanced knob that represents one embodiment of the present invention.

FIG. 20 shows an upside down, top view of a third metronome display on a display ring for an enhanced knob that represents one embodiment of the present invention. A display ring 2002 includes a display containing letters and/or numbers, such as an LCD 2004, which shows the selected number of BPM 2006. The display ring 2002 also includes sixteen LEDs, such as LED 2008, forming a ring around the perimeter of the display ring 2002. The LEDs are shown arranged similarly to the LEDs described above, with reference to the display ring 1402 shown in FIG. 14. When a number of BPMs have been selected, the LEDs shown in FIG. 20 each illuminate on each beat for a predetermined length of time. In an alternate embodiment of the present invention, the LEDs on a first side illuminate on even beats and the LEDs on a second side illuminate on odd beats. In another alternate embodiment of the present invention, the LEDs in FIG. 20 blink to create a "chase," such that each complete "chase" around the perimeter of the display ring 2002 coincides with each beat. In alternate embodiments of the present invention, the display ring 2002 does not include an LCD 2004.

Figure 21:
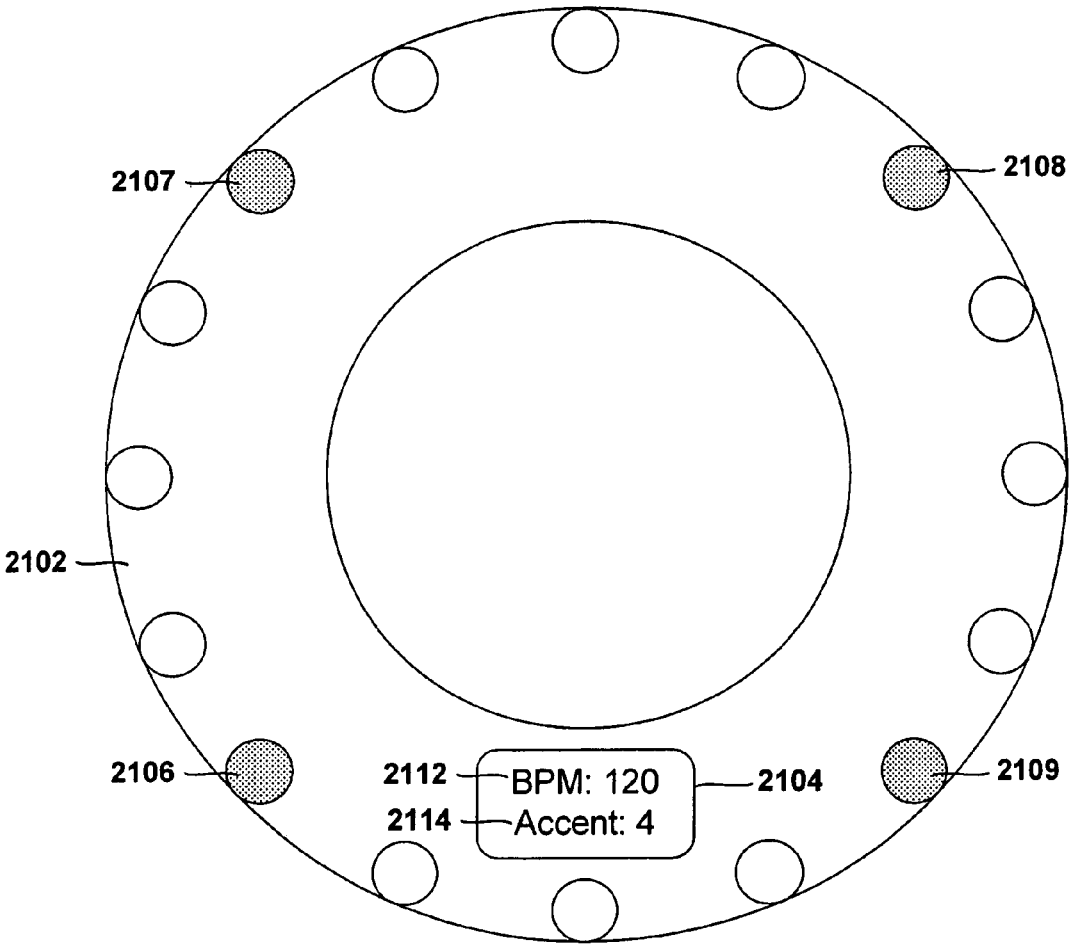
FIG. 21 shows an upside down, top view of the third metronome display shown in FIG. 20 with an accent controller that represents one embodiment of the present invention.

In other embodiments of the present invention, accents are added to selected beats. The accents may be signaled to a user through a distinctive visual and/or audio signal. Accents can be used to create "strong" and "weak" beats to represent a meter and may be used to enhance rhythmic sensing. FIG. 21 shows an upside down, top view of the third metronome display shown in FIG. 20 with an accent controller that represents one embodiment of the present invention. A display ring 2102 includes a display containing letters and/or numbers, such as an LCD 2104, and a number of LEDs forming a ring around the perimeter of the display ring 2102, such as LEDs 2106-2109. The LCD 2104 displays the selected number of BPM 2112 and also displays which beats are being accented 2114. In FIG. 21, a BPM of "120" has been selected and every "$4^{th}$" beat has been selected to be accented. Various rates of recurrence can be selected for accents, including no accent, an accent on every beat, or an accent on every Nth beat, where N is equal to any whole number greater than 1. In alternate embodiments of the present invention, a third distinct style of beat may be used, in addition to a "strong" beat and a "weak" beat, to allow for the option of selecting irregular time signatures, such as 5/4 or 7/8.

Many different displays can be utilized to visually differentiate "strong" beats from "weak" beats from "irregular-time-signature" beats. In one embodiment of the present invention, "strong" beats are indicated by all of the LEDs the display ring 2102 flashing in unison and "weak" beats are indicated by only a portion of the LEDs flashing, such as LEDs 2106-2109. When "irregular-time-signature" beats are needed, "irregular-time-signature" beats can be indicated by the flashing of a single LED. In FIG. 21, LEDs 2106-2109 are shown stippled to show that the LEDs 2106-2109 are illuminated. In another embodiment of the present invention, "strong" beats are indicated by one revolution of a "chase" around the perimeter of the display ring 2102, while "weak" beats are indicated by all, or a portion, of the LEDs flashing. When "irregular-time-signature" beats are needed, "irregular-time-signature" beats can be indicated by the flashing of a single LED. In yet other embodiments of the present invention, LEDs of varying size, intensity, and/or color are used to distinguish "strong" beats from "weak" beats from "irregular-time-signature" beats. Note that accents can be utilized with any of the various metronome displays. When aural beats are utilized, "strong," "weak," and "irregular-time-signature" beats are distinguishable by using different sounds and/or volumes for each type of beat.

In one embodiment of the present invention, BPM and/or accents can be adjusted using one or more controllers, such as one or more knobs other than an enhanced knob on the body of an electric guitar. In another embodiment of the present invention, the BPM may be adjusted by turning an enhanced knob in a first direction to increase the number of BPM and turning the enhanced knob in a second direction to decrease the number of BPM. When accents are available, one or more detents may be positioned on an enhanced knob to add an additional control mechanism to use to adjust the accents. In yet another embodiment of the present invention, the BPM is set by a double string pluck. A user may adjust BPM by switching the enhanced knob to the metronome function and double plucking a string. The time period between the two plucks is used as the time period in between subsequent beats.

Figure 22:
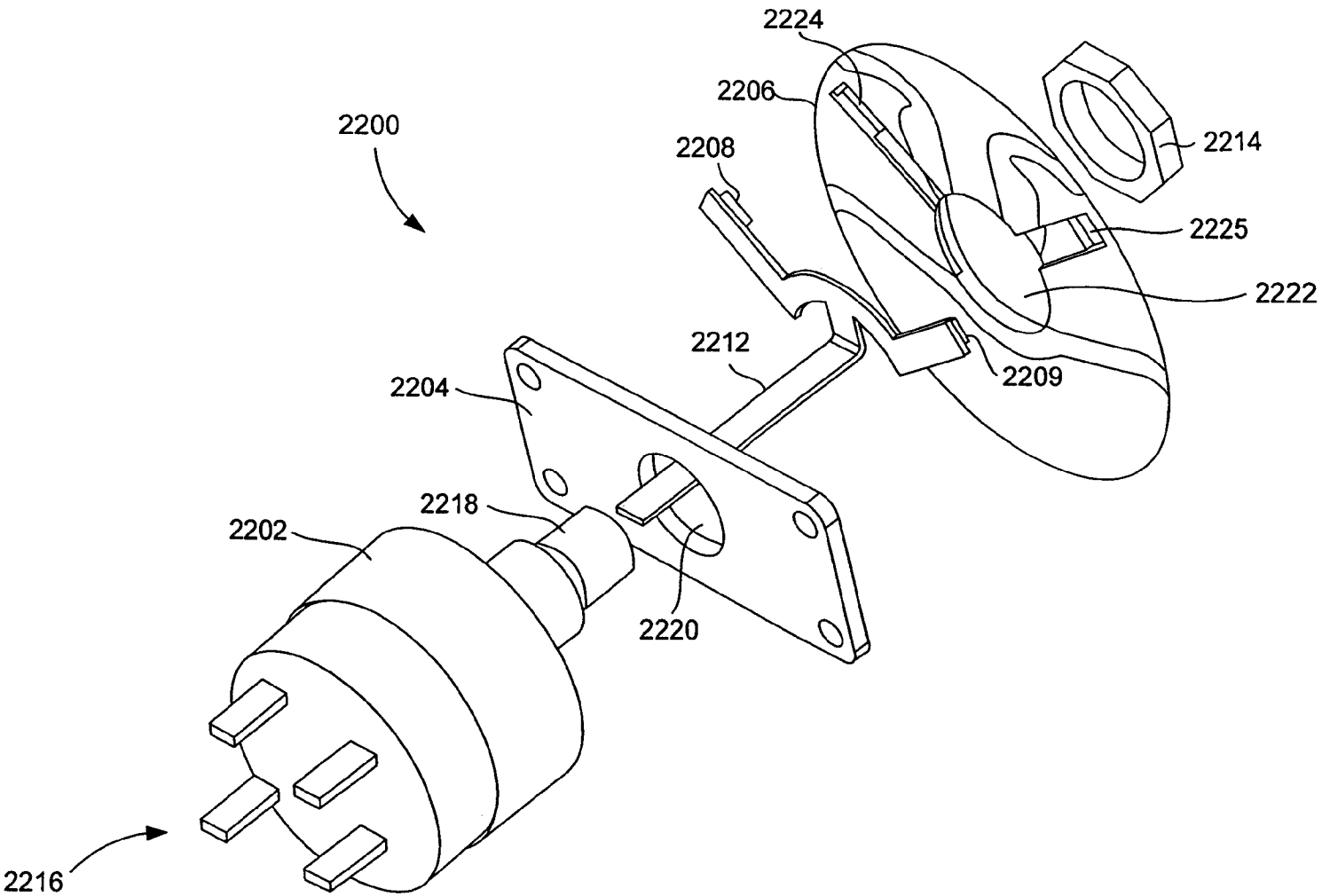
FIG. 22 shows an exploded view of an enhanced knob with a metronome function that represents one embodiment of the present invention.

FIG. 22 shows an exploded view of an enhanced knob with a metronome function that represents one embodiment of the present invention. An enhanced knob 500 with a metronome function includes a pot 2202, a PCB 2204, a display ring 2206, two LEDs 2208 and 2209, an electronically-communicating means 2212 for interconnecting the pot 2202 to the LEDs 2208 and 2209, and a nut 2214 that mates with the pot 2202 to hold the PCB 2204 and the display ring 2206 firmly against the pot 2202. The pot 2202 contains leads 2216 for interconnecting the pot 502 to an instrument circuit, such as the electric-guitar circuit shown in FIG. 3, and a stem 2218 with a threaded base (not shown in FIG. 22) onto which the nut 2212 can be threaded and that can also be used to interconnect a knob cap (not shown in FIG. 22) for use by an user for grasping and using the enhanced knob 2200. The PCB 2204 is shown with a mounting aperture 2220 that fits around the threaded base of the stem 2218 so the PCB 2204 can be slid down the stem 2218. Additionally, the display ring 2206 contains a central aperture 2222 that fits around the threaded base of the stem 2218 so the display ring 2206 can also be slid down the stem 2218. The underside of the display ring 2206 contains two depressions 2224 and 2225 into which the LEDs 2208 and 2209 can be placed. In alternate embodiments of the present invention, an enhanced knob includes both a tuner function and a metronome function. A concentric-shaft pot with two concentric shafts can be used to accommodate both functions on a single enhanced knob. In a first embodiment, the tuner and the metronome both utilize the same display ring. In a second embodiment, the tuner and the metronome each utilize a separate display ring. When multiple display rings are utilized, the display rings can be stacked on top of one another along a stem of a pot.

Figure 23:
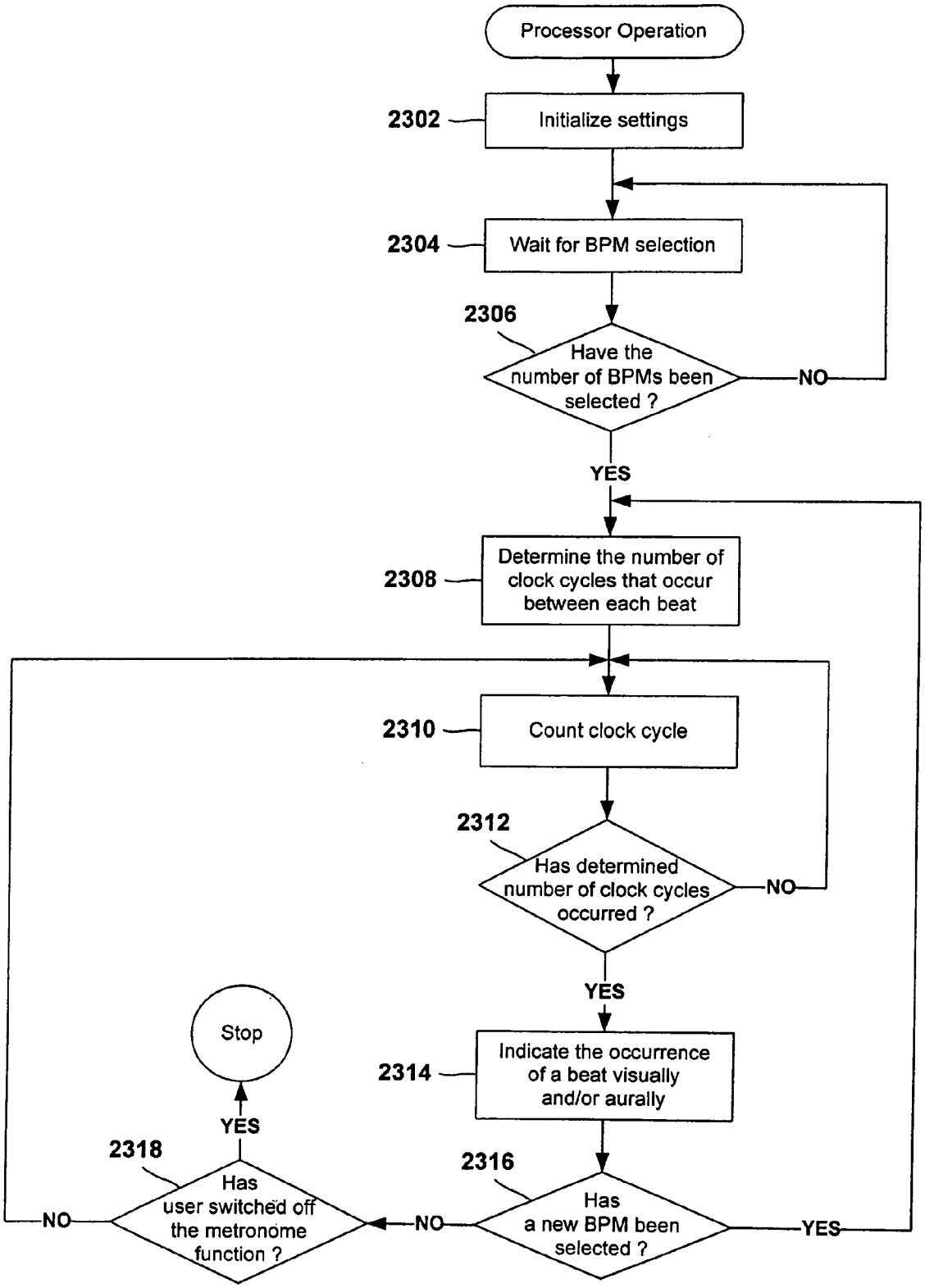
FIG. 23 shows a control-flow diagram for a metronome operation by a processor in an enhanced knob that represents one embodiment of the present invention.

In one embodiment of the present invention, the enhanced knob includes a processor programmed with an algorithm that counts clock cycles on the internal clock of the processor to determine when to indicate a beat. FIG. 23 shows a control-flow diagram for a metronome operation by a processor in an enhanced knob that represents one embodiment of the present invention. In step 2302, the processor settings are initialized. In step 2304, the processor waits for a user to select a number of BPMs. When, in step 2306, the number of BPMs has not been selected, control is passed back to step 2304. Otherwise, in step 2308, the number of clock cycles that occur between each beat is determined. In step 2310, the processor counts a clock cycle. When, in step 2312, more clock cycles are needed before a beat, control is passed back to 2308. Otherwise, in step 2314, the occurrence of a beat is indicated by illuminating one or more LEDs for a predetermined length of time on a display and/or sending a signal to an interconnected amplifier to produce an audible sound for a predetermined length of time. When, in step 2316 a new BPM has been selected, control is passed back to step 2308. Otherwise, when, in step 2318, a user has switched off the metronome function, the metronome function stops. Otherwise, control is passed back to step 2310.

Figure 24:
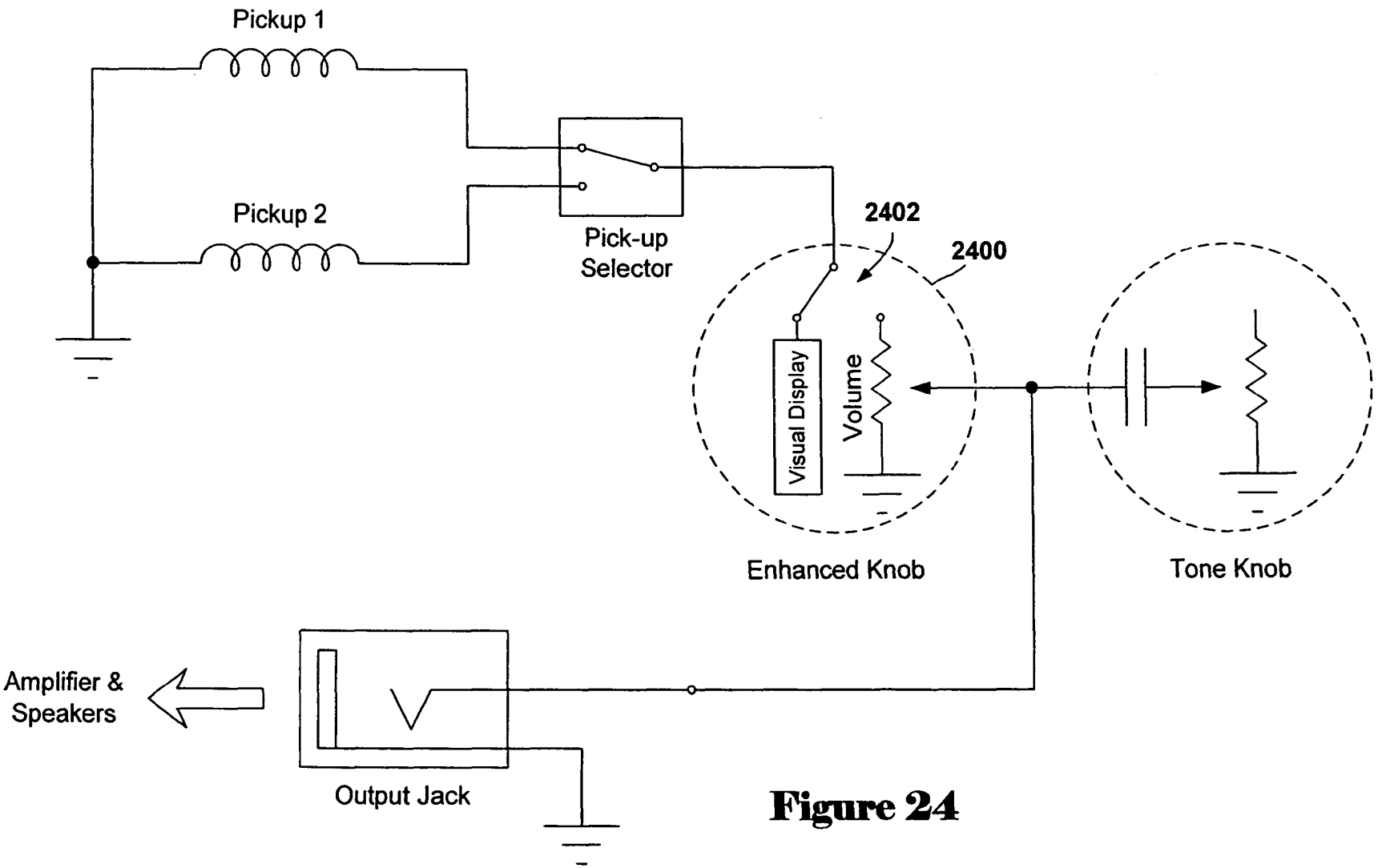
FIG. 24 shows a schematic diagram of an instrument circuit with a volume knob replaced with an enhanced knob with a visual-display function that represents one embodiment of the present invention.

In one embodiment of the present invention, the volume knob for an instrument is replaced with an enhanced knob that includes a volume function and a dynamic visual-display function. FIG. 24 shows a schematic diagram of an instrument circuit with a volume knob replaced with an enhanced knob with a visual-display function that represents one embodiment of the present invention. In FIG. 24, an enhanced knob 2400 is shown as a dashed circle surrounding a volume function and a dynamic visual-display function. The enhanced knob 2400 includes a switch 2402 for switching between the volume function and the dynamic visual-display function. Both the volume function and the dynamic visual-display function are user controlled. Thus, a user can use the enhanced knob 2400 to select and control the volume function or to switch to the dynamic visual-display function and use the enhanced knob 2400 for creating a dynamic visual display. As described above, with reference to FIGS. 4A and 4B, in alternate embodiments of the present invention the enhanced knob may, instead, replace a knob on an amplifier, or be an add-on feature for either an instrument or an amplifier.

Figure 25:
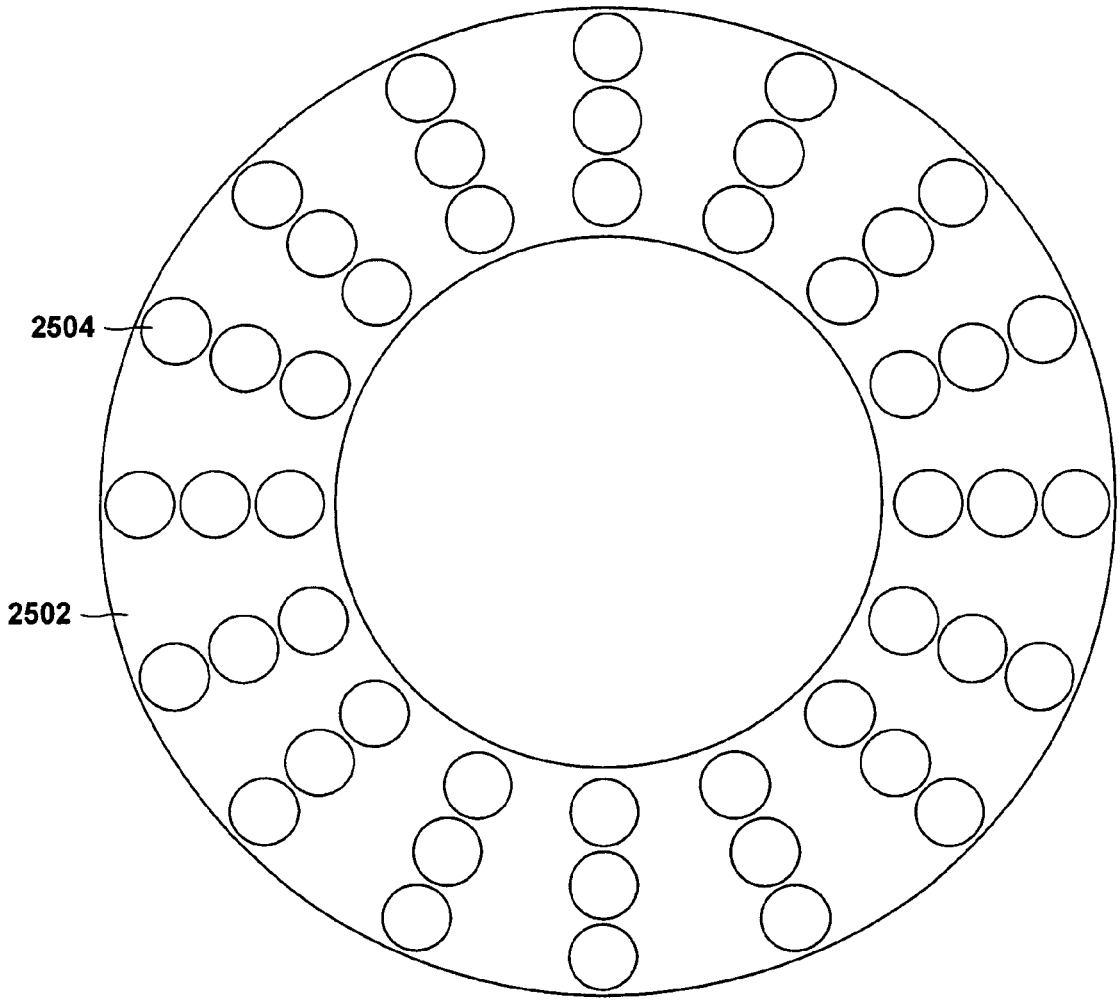
FIG. 25 shows a light display on a display ring for an enhanced knob that represents one embodiment of the present invention.

FIG. 25 shows a light display on a display ring for an enhanced knob that represents one embodiment of the present invention. A display ring 2502 includes three rings of LEDs, such as LED 2504, around the perimeter of the display ring 2504. In alternate embodiments of the present invention, variable numbers of LEDs are used around the perimeter of the display ring 2502. The LEDs can also be of various colors, sizes, and/or intensities. An interconnected processor is programmed to automatically flash the LEDs in a number of different patterns by counting clock cycles to determine when to flash each LED. The interconnected processor may be programmed by various entities along a distribution pathway, including a manufacturer, a distributor, a retailer, a user, or other entity. The interconnected processor may be programmed to flash the LEDs in either a preset pattern, a random pattern, a pattern that varies according to the music being played, or in a combination of two or more of the above-listed patterns. Pots with two or more concentric shafts can be utilized by an enhanced knob to combine a light-display function with additional functions on a single enhanced knob. In alternate embodiments of the present invention, the arrangement of the LEDs shown in FIG. 25 for use with the light-display function can also be used for the metronome function and/or the tuner function. Similarly, the LED arrangements shown in FIGS. 8-14 and 18-21 can be used for the light-display function.

When an enhanced knob includes more than two functions, the enhanced knob includes an appropriate multi-function switch to allow a user to switch between the multiple functions. In various embodiments, each of the functions utilizes one or more display rings. When multiple display rings are utilized, the display rings can be stacked on top of one another along a stem of the pot. In an alternate embodiment of the present invention, multiple enhanced knobs with different functions are used in combination. For example, an instrument and interconnected amplifier may be equipped with two enhanced knobs with different functions. The volume knob on the instrument may be replaced with a first enhanced knob with a volume function and a metronome function. Meanwhile, an interconnected amplifier may include an enhanced knob that is an add-on feature with a tuner function and a visual-display function.

An enhanced knob may be used by more than one instrument. For example, when an enhanced knob is positioned on an amplifier and includes a guitar-tuner function, a first electric guitar can interconnect to the amplifier with an electric-guitar cable and the first electric guitar can be tuned. Subsequently, a second electric guitar can be interconnected to the amplifier, using either the same electric-guitar cable or a different electric-guitar cable, and be tuned. Alternately, when an enhanced knob with a guitar-tuner function is positioned on a first electric guitar, a second electric guitar can be tuned by interconnecting the second electric guitar to the first electric guitar by connecting an electric-guitar cable into the output jacks of the first and the second electric guitars.

Additional modifications within the spirit of the invention will be apparent to those skilled in the art. For example, the size, colorings, and intensities of the displays and the lights used in various displays can be varied. The materials used to fabricate display rings can be varied as well. Other symbols besides an inverted-isosceles-triangle symbol can be used to indicate that a string is in tune. A variety of shapes and sizes of knob caps can be used to create a desired look on an instrument. Placement of an enhanced knob on an instrument or an amplifier that replaces an existing knob may be set by the placement of the existing knob. However, placement of an enhanced knob on an instrument or an amplifier that is an add-on feature can be variable and may depend on the desires of the user and the size, shape, and wiring of the instrument or amplifier.

The foregoing detailed description, for purposes of illustration, used specific nomenclature to provide a thorough understanding of the invention. However, it will be apparent to one skilled in the art that the specific details are not required in order to practice the invention. Thus, the foregoing descriptions of specific embodiments of the present invention are presented for purposes of illustration and description; they are not intended to be exhaustive or to limit the invention to the precise forms disclosed. Obviously many modifications and variation are possible in view of the above teachings. The embodiments were chosen and described in order to best explain the principles of the invention and its practical applications and to thereby enable others skilled in the art to best utilize the invention and various embodiments with various modifications as are suited to the particular use contemplated.

The invention claimed is:

1. An enhanced knob for use with an electric stringed musical instrument, the enhanced knob comprising:

an original function selected from among a volume-control function, a tone-adjustment function, and a pick-up selector function;

a tuner function for indicating the pitch of the strings of the electric stringed musical instrument, the tuner function powered by a power supply external to the enhanced knob; and at least one display, for displaying tuner-function output, the display comprising an annular display surface, oriented approximately parallel with respect to a mounting surface of the electric stringed musical instrument and not occluded or overlapped by the original function;

wherein a processor performs operations for the tuner function.

2. The enhanced knob of claim 1 wherein the electric stringed musical instrument is interconnected to an amplifier.

3. The enhanced knob of claim 2 wherein the enhanced knob is positioned on one or more of the electric stringed musical instrument, and the interconnected amplifier.

4. The enhanced knob of claim 3 wherein the enhanced knob replaces a volume knob on one or more of the electric stringed musical instrument, and the amplifier.

5. The enhanced knob of claim 4 wherein the enhanced knob further includes a volume function for adjusting the volume of the sound output from the amplifier; and a switch for switching between the volume function and the tuner function.

6. The enhanced knob of claim 3 wherein the enhanced knob replaces a tone knob on one or more of the electric stringed musical instrument, and the amplifier.

7. The enhanced knob of claim 6 wherein the enhanced knob further includes a tone function for adjusting the timbre of the sound output from the amplifier; and a switch for switching between the tone function and the tuner function.

8. The enhanced knob of claim 3 wherein the at least one display is positioned on one or more of a number of display rings interconnected to the enhanced knob, a number of light pipes, and a number of pop-out displays.

9. The enhanced knob of claim 1 wherein the at least one display comprises a number of illumination sources, each illumination source one or more of a number of light-emitting diodes, a number of liquid crystal displays, a number of organic light-emitting diodes, a number of vacuum fluorescent displays, a number of dot matrix displays, and a number of seven-segment light-emitting-diode displays.

10. The enhanced knob of claim 1 wherein the processing operations performed by the processor for the tuner function include determining the frequency of a musical note played on the electric stringed musical instrument and comparing the frequency of the musical note played on the electric stringed musical instrument to the frequencies of stored tones.

11. The enhanced knob of claim 10 wherein the at least one display displaying processing-operation results for the tuner function includes a number of first illumination sources that illuminate when the frequency of the musical note played on the electric stringed musical instrument is greater than a predetermined threshold amount above the nearest stored tone and a number of second illumination sources that illuminate when the frequency of the musical note played on the electric stringed musical instrument is less than a predetermined threshold amount below the nearest stored tone.

12. The enhanced knob of claim 11 wherein the number of first illumination sources and the number of second illumination sources illuminate and turn off in a frequency that is dependent on the distance in frequency of the musical note played on the electric stringed musical instrument from the nearest stored tone.

13. The enhanced knob of claim 11 wherein the at least one display displaying processing-operation results for the tuner function further includes a number of third illumination sources that illuminate to indicate the nearest stored tone to the musical note played on the electric stringed musical instrument.

14. The enhanced knob of claim 10 wherein the at least one display displaying processing-operation results for the tuner function includes a ring of illumination sources that sequentially flash to create a chase effect.

15. The enhanced knob of claim 14 wherein the apparent velocity of the chase effect is dependent on the distance in frequency of the musical note played on the electric stringed musical instrument from the nearest stored tone.

16. The enhanced knob of claim 14 wherein the chase effect is in a first direction when the frequency of the musical note played on the electric stringed musical instrument is greater than a predetermined threshold amount above the nearest stored tone, and the chase is in a second direction when the frequency of the musical note played on the electric stringed musical instrument is less than a predetermined threshold amount below the nearest stored tone.

17. An electric-stringed-musical-instrument system comprising:

an electric stringed musical instrument;

an amplifier interconnected to the electric stringed musical instrument; and an enhanced knob interconnected to the electric-stringed-musical-instrument system, the enhanced knob including one or more of a tuner function for indicating the pitch of the strings of the electric stringed musical instrument, the tuner function powered by a power supply external to the enhanced knob; and a visual-display function for adding a visual element while playing the electric stringed musical instrument, the visual-display function powered by a power supply external to the enhanced knob; and at least one display, contained within the enhanced knob, for displaying tuner-function output and visual-display-function output, the display comprising an annular display surface, oriented approximately parallel with respect to a mounting surface of the electric stringed musical instrument and not occluded or overlapped by the original function;

wherein a processor performs operations for the tuner function and the visual-display function.

18. The electric-stringed-musical-instrument system of claim 17 wherein the enhanced knob is positioned on one or more of the electric stringed musical instrument, and the interconnected amplifier.

19. The electric-stringed-musical-instrument system of claim 18 wherein the enhanced knob replaces one or more of a volume knob, and a tone knob.

20. The electric-stringed-musical-instrument system of claim 17 wherein the processing operations performed by the processor for the tuner function include determining the frequency of a musical note played on the electric stringed musical instrument and comparing the frequency of the musical note played on the electric stringed musical instrument to the frequencies of stored tones.

21. The electric-stringed-musical-instrument system of claim 20 wherein the at least one display displaying processing-operation results for the tuner function includes a number of first illumination sources that illuminate when the frequency of the musical note played on the electric stringed musical instrument is greater than a predetermined threshold amount above the nearest stored tone and a number of second illumination sources that illuminate when the frequency of the musical note played on the electric stringed musical instrument is less than a predetermined threshold amount below the nearest stored tone.

22. The electric-stringed-musical-instrument system of claim 21 wherein the number of first illumination sources and the number of second illumination sources illuminate and turn off in a frequency that is dependent on the distance in frequency of the musical note played on the electric stringed musical instrument from the nearest stored tone.

23. The electric-stringed-musical-instrument system of claim 21 wherein the at least one display displaying processing-operation results for the tuner function further includes a number of third illumination sources that illuminate to indicate the nearest stored tone to the musical note played on the electric stringed musical instrument.

24. The electric-stringed-musical-instrument system of claim 20 wherein the at least one display displaying processing-operation results for the tuner function includes a ring of illumination sources that sequentially flash to create a chase effect.

25. The electric-stringed-musical-instrument system of claim 24 wherein the apparent velocity of the chase effect is dependent on the distance in frequency of the musical note played on the electric stringed musical instrument from the nearest stored tone.

26. The electric-stringed-musical-instrument system of claim 24 wherein the chase effect is in a first direction when the frequency of the musical note played on the electric stringed musical instrument is greater than a predetermined threshold amount above the nearest stored tone, and the chase is in a second direction when the frequency of the musical note played on the electric stringed musical instrument is less than a predetermined threshold amount below the nearest stored tone.

27. An enhanced knob for use with an electric stringed musical instrument, the enhanced knob comprising:

an original function selected from among a volume-control function, a tone-adjustment function, and a pick-up selector function;

a tuner function for indicating the pitch of the strings of the electric stringed musical instrument, the tuner function powered by a power supply external to the enhanced knob; and at least one display, for displaying tuner-function output;

wherein a processor performs operations for the tuner function, wherein the electric stringed musical instrument is interconnected to an external amplifier, and wherein the enhanced knob is positioned on the amplifier.

28. An electric-stringed-musical-instrument system comprising:

an electric stringed musical instrument;

an amplifier interconnected to the electric stringed musical instrument; and an enhanced knob interconnected to the electric-stringed-musical-instrument system, the enhanced knob including one or more of a tuner function for indicating the pitch of the strings of the electric stringed musical instrument, the tuner function powered by a power supply external to the enhanced knob; and a visual-display function for adding a visual element while playing the electric stringed musical instrument, the visual-display function powered by a power supply external to the enhanced knob; and at least one display, contained within the enhanced knob, for displaying tuner-function output and visual-display-function output;

wherein a processor performs operations for the tuner function and the visual-display function and wherein the enhanced knob is positioned on the amplifier.

* * * * *